US011122384B2

(12) United States Patent
Yadegari

(10) Patent No.: US 11,122,384 B2
(45) Date of Patent: Sep. 14, 2021

(54) DEVICES AND METHODS FOR BINAURAL SPATIAL PROCESSING AND PROJECTION OF AUDIO SIGNALS

(71) Applicant: The Regents of the University of California, Oakland, CA (US)

(72) Inventor: Shahrokh Yadegari, La Jolla, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 0 days.

(21) Appl. No.: 16/646,981

(22) PCT Filed: Sep. 12, 2018

(86) PCT No.: PCT/US2018/050756
§ 371 (c)(1),
(2) Date: Mar. 12, 2020

(87) PCT Pub. No.: WO2019/055572
PCT Pub. Date: Mar. 21, 2019

(65) Prior Publication Data

US 2020/0260209 A1 Aug. 13, 2020

Related U.S. Application Data

(60) Provisional application No. 62/557,647, filed on Sep. 12, 2017.

(51) Int. Cl.
*H04S 7/00* (2006.01)

(52) U.S. Cl.
CPC ..... *H04S 7/304* (2013.01); *H04S 2400/13* (2013.01); *H04S 2420/01* (2013.01)

(58) Field of Classification Search
None
See application file for complete search history.

(56) References Cited

U.S. PATENT DOCUMENTS

| | | | | |
|---|---|---|---|---|
| 5,027,687 | A | 7/1991 | Iwamatsu | |
| 5,784,467 | A | 7/1998 | Asayama | |
| 6,072,877 | A * | 6/2000 | Abel | H04S 1/002 381/17 |
| 6,111,962 | A | 8/2000 | Akio | |
| 6,154,549 | A | 11/2000 | Arnold et al. | |
| 6,430,535 | B1 | 8/2002 | Spille et al. | |
| 7,099,482 | B1 | 8/2006 | Jot et al. | |
| 8,515,105 | B2 | 8/2013 | Yadegari | |

(Continued)

OTHER PUBLICATIONS

ISA, International Search Report and Written Opinion for International Application No. PCT/US2018/050756, dated Nov. 30, 2018. 17 pages.

(Continued)

*Primary Examiner* — Mark Fischer
(74) *Attorney, Agent, or Firm* — Perkins Coie LLP

(57) ABSTRACT

Disclosed are devices, systems and methods for binaural spatial audio processing based on a pair of head-related transfer functions (HRTFs) for each of a listener's two ears to synthesize a binaural sound that seems to come from a particular point in space. Applications of the disclosed devices, systems and methods include digital audio reproduction, recording, and multimedia applications including virtual reality and augmented reality experiences.

28 Claims, 25 Drawing Sheets

(56) References Cited

U.S. PATENT DOCUMENTS

| | | | | |
|---|---|---|---|---|
| 9,992,602 | B1 * | 6/2018 | Allen | H04S 3/004 |
| 2001/0040968 | A1 * | 11/2001 | Mukojima | H04S 1/002 381/17 |
| 2004/0234076 | A1 | 11/2004 | Agostini | |
| 2005/0190925 | A1 * | 9/2005 | Miura | H04S 1/002 381/17 |
| 2006/0045294 | A1 | 3/2006 | Smyth | |
| 2006/0083394 | A1 | 4/2006 | McGrath | |
| 2009/0046864 | A1 | 2/2009 | Mahabub et al. | |
| 2010/0080396 | A1 * | 4/2010 | Aoyagi | H04S 1/005 381/17 |
| 2013/0170679 | A1 * | 7/2013 | Nystrom | H04R 5/033 381/311 |
| 2014/0064526 | A1 | 3/2014 | Otto et al. | |
| 2014/0321680 | A1 * | 10/2014 | Takahashi | H04S 7/304 381/303 |
| 2016/0227338 | A1 * | 8/2016 | Oh | H04S 7/303 |
| 2016/0373877 | A1 | 12/2016 | Laitinen | |
| 2017/0078821 | A1 | 3/2017 | Faller et al. | |
| 2017/0180907 | A1 | 6/2017 | Kuhr et al. | |
| 2017/0366912 | A1 * | 12/2017 | Stein | H04S 7/304 |

OTHER PUBLICATIONS

Kaup, A., LMS Introduction, Friedrich-Alexander University Erlangen-Nuremberg, <http://www.lnt.de/LMS/research/projects/WPS/index> retrieved on Oct. 2, 2009, 3 pages.

Moore, F.R., "The Computer Audio Research Laboratory at UCSD," Computer Music Journal, 6(1):18-29, 1982.

Moore, F.R., "A General Model for Spatial Processing of Sounds", Computer Music Journal, 7(3):6-15, 1983.

TKK Akustiikka, "Vector base amplitude panning", obtained Dec. 5, 2008 «http://www.acoustics.hut.fi/research/cat/vbap/», 2 pages.

Yadegari, S., et al., "Real-Time Implementation of a General Model for Spatial Processing of Sounds", Center for Research in Computing and the Arts, San Diego, CA, 2002, 4 pages.

Yadegari. S. "Chaotic Signal Synthesis with Real-Time Control: Solving Differential Equations in PD, Max/MSP, and JMax," Proceedings of the 6th International Conference on Digital Audio Effects, London, UK, Sep. 2003, 4 pages.

Yadegari, S., "Inner Room Extension of a General Model for Spatial Processing of Sounds," Proceedings of International Computer Music Conference, pp. 244-247, Sep. 2005.

* cited by examiner

500

DEVICES AND METHODS FOR BINAURAL SPATIAL PROCESSING AND PROJECTION OF AUDIO SIGNALS

CROSS-REFERENCE TO RELATED APPLICATIONS

This patent document is a 371 National Phase Application of PCT Application No. PCT/US2018/050756 entitled "DEVICES AND METHODS FOR BINAURAL SPATIAL PROCESSING AND PROJECTION OF AUDIO SIGNALS" filed on Sep. 12, 2018, which claims priorities to and benefits of U.S. Provisional Patent Application No. 62/557,647 entitled "DEVICES AND METHODS FOR BINAURAL SPATIAL PROCESSING AND PROJECTION OF AUDIO SIGNALS" filed on Sep. 12, 2017. The entire content of the aforementioned patent applications incorporated by reference as part of the disclosure of this patent document.

TECHNICAL FIELD

This patent document relates to audio signal processing techniques.

BACKGROUND

Audio signal processing is the intentional modification of sound signals to create an auditory effect for a listener to alter the perception of the temporal, spatial, pitch and/or volume aspects of the received sound. Audio signal processing can be performed in analog and/or digital domains by audio signal processing systems. For example, analog processing techniques can use circuitry to modify the electrical signals associated with the sound, whereas digital processing techniques can include algorithms to modify the digital representation, e.g., binary code, corresponding to the electrical signals associated with the sound.

SUMMARY

Disclosed are devices, systems and methods for binaural spatial audio processing based on a set of measured pairs of head-related transfer functions (HRTFs) for each of a listener's two ears to synthesize a binaural sound that seems to come from a particular point in space. Applications of the disclosed devices, systems and methods include digital audio reproduction, recording, and multimedia applications including virtual reality and augmented reality experiences.

In some example embodiments in accordance with the present technology, a method for binaural audio signal processing includes generating a first head-related transfer function (HRTF) for a left ear of a listener based on a sound to be synthesized from a source located at a first distance from the listener's left ear; generating, separately with respect to the first HRTF, a second HRTF for a right ear of the listener based on the sound to be synthesized from the source located at a second distance from the listener's right ear; and synthesizing a binaural sound for a first speaker corresponding to the left ear of the listener and a second speaker corresponding to the right ear of the listener, in which the synthesized binaural sound contains spatial auditory information to simulate the sound emanating from the source differently in each ear of the listener based on the separate first and second HRTFs for the left ear and the right ear, respectively.

In some example embodiments in accordance with the present technology, a binaural audio device includes a first speaker to project a first synthesized audio output to one of two ears of a listener; a second speaker to project a second synthesized audio output to the other of the two ears of the listener; a data processing unit in communication with the first speaker and second speaker to produce distinct binaural audio outputs for the first speaker and the second speaker; and a binaural audio processing module to generate a first head-related transfer function (HRTF) for a first ear of the two ears of the listener and a second HRTF for a second ear of the two ears of the listener, in which the binaural audio processing module is configured to separately generate the first HRTF and the second HRTF based on a sound to be synthesized from a source located at a distance from the listener, and to synthesize a binaural sound including the first and the second synthesized audio outputs for the first and the second speakers, respectively, in which the synthesized binaural sound contains spatial auditory information to simulate the sound emanating from the source differently in each ear of the listener.

In some example embodiments in accordance with the present technology, a method for binaural audio signal processing includes interpolating a head-related transfer function (HRTF) for each of a left ear and a right ear of a listener; calculating distances between a source of a sound to be synthesized and each of the left ear and right ear of the listener; calculating at least one of one or more delay parameters, one or more attenuation parameters, or one or more angles associated with each ear using the calculated distances; interpolating values per block of a space covering at least the listener and the source of the sound; applying a convolution including the interpolated values per block and the interpolated HRTF for each ear; and synthesizing a binaural sound for a first speaker corresponding to the left ear of the listener and a second speaker corresponding to the right ear of the listener, in which the synthesized binaural sound contains spatial auditory information to simulate the sound emanating from the source differently in each ear of the listener.

In some example embodiments in accordance with the present technology, a method for producing intermediary head-related transfer functions (HRTFs) includes determining parameters associated with a sound to be synthesized, in which the parameters include spatial parameters of the sound with respect to a listener; selecting one or more premade HRTFs from a published database having a plurality of the premade HRTFs based on the determined spatial parameters; decoupling left ear and right ear impulses of the selected one or more premade HRTFs; removing delay information from the selected one or more premade HRTFs; and adjusting volume information of the selected one or more premade HRTFs, in which the decoupling, removing, and adjusting produces a modified HRTF set.

In some embodiments in accordance with the present technology, a method for binaural spatial audio processing includes a digital signal processing algorithm for three dimensional localization of a fictitious sound source for a listener using headphones. The fictitious sound sources can simulate an auditory experience for the user in any outdoor or indoor environment. The digital signal processing algorithm includes a technique to select one or more head-related transfer functions (HRTFs) from a database of single-distance or multi-distance mono or stereo HRTFs and to modify the selected one or more HRTFs to create a binaural audio effect in the two separate (left and right) speakers of the headphones associated with the listener's left and right ears.

In implementations, the method decouples and processes the HRTFs for each ear. In a synthesis phase, the appropriate HRTF, as well as the delay and attenuation values of the direct and reflected rays for each ear are chosen and applied to each direct and reflected rays in the environment, e.g., such as a room. Implementations of the method can be used in wide and important applications in the games, entertainment, virtual reality, and augmented reality fields.

The subject matter described in this patent document can be implemented in specific ways that provide one or more of the following features.

DETAILED DESCRIPTION

Figure 1A:
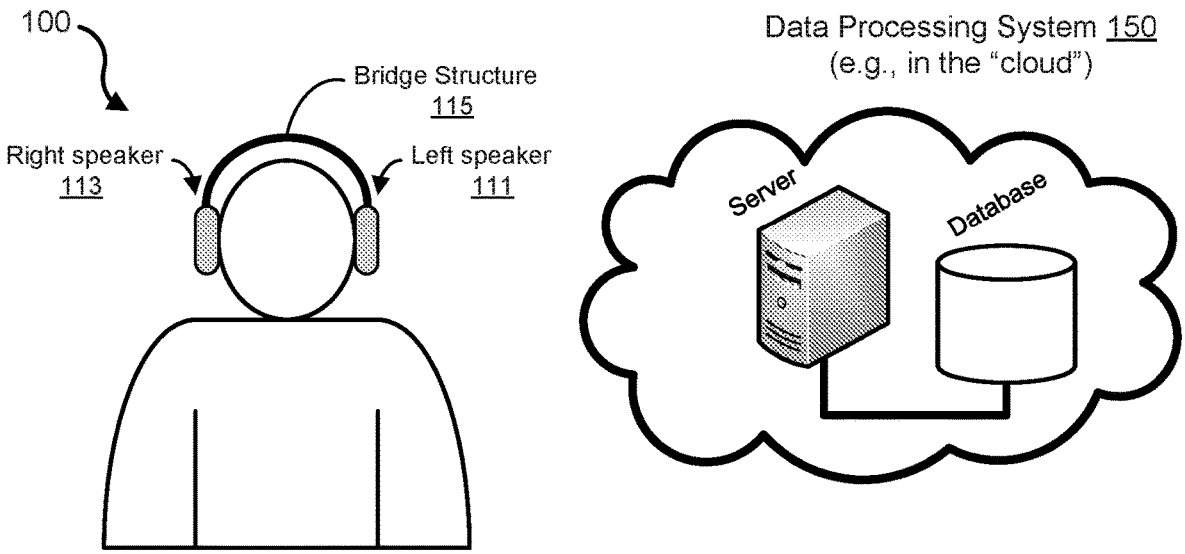
FIG. 1A shows a diagram of an example embodiment of a binaural audio processing system in accordance with the present technology.

"Binaural" means having or relating to two ears. Human anatomy and physiology allows humans to hear binaurally. Binaural hearing, along with frequency cues, lets humans and other animals determine the direction and origin of sounds.

The two ears of a listener receive first the direct ray of a sound source, and then, subsequently, the reflections of the sounds from objects in the environment, such as the walls, floor, or ceiling of a room. These reflections are generally classified in two different sets: early reflections, and diffused reverberation.

Humans are able to perceive the location of sound sources based on a number of physical aural cues. Four of the most important cues for perception of localization include (1) interaural time difference (ITD), (2) interaural level difference (ILD), (3) head related transfer function (HRTF), and (4) direct to reverberation sound level ratio.

ITD is the difference in time between the arrival of a sound wave to the two ears. The sooner a sound arrives to one ear, the more likely that the sound is located in the direction of the ear which receives the sounds earlier.

ILD is the difference in level between the power of a sound wave arriving to the two ears. The louder a sound is in one ear, the more likely that the sound is located in the direction of the ear which receives the louder signal.

Other than the ITD and ILD, the sound waves arriving to each ear is filtered by the form of the head, torso, and ears of each person. This filter for each ear is defined as the Head Related Transfer Function (HRTF). The sounds arriving to each ear is filtered differently depending on the direction of the sound ray arriving to the ear and the brain uses the filtration difference between the two ears and the filtration difference in time to detect spatialization cues.

When a sound is close to a listener, the ratio of the level of direct ray to reverberation level is higher compared to when a sound source is farther away. Also, depending on the geometry of the space in which the sound is being diffused, the time difference between the arrival of the direct ray and the reverberant field is larger when a sound is close to the listener compared to when the sound is closer to a reflective surface.

In audio processing, binaural sound recordings are produced by a stereo recording of two microphones inside the ears of a subject, e.g., a living human or a mannequin head. Such recordings include most cues for sound spatialization detected by humans, and thus, they are able to realistically transmit the localization of the recorded sounds, and in effect provide a three dimensional experience of the soundscape for the listener.

Binaural synthesis is the process of simulating the audio spatialization cues which are caused by the anatomy of the head, ear and torso for the two ears using digital signal processing. One of the typical ways this synthesis is done is by convolution of a sound source with an impulse response which has been previously measured for a specific location. Thus if we define the HRTF for location r, Θ, φ, (where r is the radius, Θ the azimuth angle, and φ the elevation angle of the source), as $H_L(r,\Theta,\varphi)$ for the left channel and $H_R(r,\Theta,\varphi)$ for the right channel, and the denote X as the sound localization being simulated for exactly the same position as the HRTF were measured, the synthesized sound by $Y_L$ for the left channel, and $Y_R$ for the right channel, would be obtained by Equations 1 and 2.

$$Y_L=X*H_L(r,\Theta,\varphi) \quad (1)$$

$$Y_R=X*H_R(r,\Theta,\varphi) \quad (2)$$

HRTF databases are created by quantizing the space usually in a sphere around a subject's head or a dummy head and measuring the impulse response for specific points in space. Existing HRTF databases have the HRTF measurements for a single sphere around head; and some databases include measurements for multiple distances to the center of the head as well. Yet, if one wants to spatialize audio for an arbitrary position in space, some form of interpolation needs to take place to find the correct parameter values for the ITD, ILD, and HRTF based on the already measured locations.

None of the existing HRTF databases account for true binaural synthesis, that is synthesizing a sound with a spatial aspect that would mimic a true sound heard in each ear of the listener. Rather, conventional techniques for spatial audio processing produces an output on a speaker that lacks a realistic effect that the synthesized sound should have on the listening experience of the subject.

Disclosed are devices, systems and methods for binaural spatial audio processing based on a pair of head-related transfer functions (HRTFs) for each of a listener's two ears to synthesize a binaural sound that seems to come from a particular point in space. Applications of the disclosed devices, systems and methods include digital audio reproduction, recording, and multimedia applications including virtual reality and augmented reality experiences.

In some embodiments, a method for binaural spatial audio processing includes a digital signal processing algorithm for three dimensional localization of a fictitious sound source for a listener using headphones. The fictitious sound sources can simulate an auditory experience for the user in any outdoor or indoor environment. The digital signal processing algorithm includes a technique to select one or more head-related transfer functions (HRTFs) from a database of single-distance or multi-distance mono or stereo HRTFs and to modify the selected one or more HRTFs to create a binaural audio effect in the two separate (left and right) speakers of the headphones associated with the listener's left and right ears. In implementations, the method decouples and processes the HRTFs for each ear, producing a new HRTF for the left ear and a new HRTF for the right ear. In some implementations, the decoupling and processing of the selected HRTF includes determination of various spatial parameters associated with the environment of the listener (e.g., objects in the path of the fictitious sound's travel from its origin), and/or determination of various anatomical or physiological parameters associated with the listener. In a synthesis phase, the appropriate HRTF, as well as the delay and attenuation values of the direct and reflected rays for each ear are chosen and applied to each direct and reflected rays in the environment, e.g., such as a room.

FIG. 1A shows a diagram of an example embodiment of a binaural audio processing system in accordance with the present technology that includes a binaural audio device 100 in communication with a data processing system 150. In some embodiments, like that shown in the diagram of FIG. 1A, the binaural audio device 100 can be configured as a portable pair of headphones worn by a listener to play sounds produced by the audio source, e.g., music player, video game console, television, etc., and modified by the system to create a binaural spatial aspect to the audio output. In some implementations, the portable pair of headphones includes a pair of left and right speakers in wired or wireless communication with the audio source; and in some implementations, the portable pair of headphones include a pair of left and right speakers 111, 113 connected by a headrest bridge structure 115.

In some implementations, the audio source is a smartphone, tablet or other mobile computing device (e.g., operating a media application to produce the audio output), in which the data processing system 150 is resident on the smartphone and configured to create a binaural spatial aspect to the audio output and provide the binaural spatial audio output to the binaural audio device 100, which is connected in data communication with the smartphone. For example, the binaural audio device 100 can be configured in wireless communication with the audio source (e.g., smartphone); whereas in other embodiments, the binaural audio device 100 is configured in wired communication with the audio source.

Figure 1B:
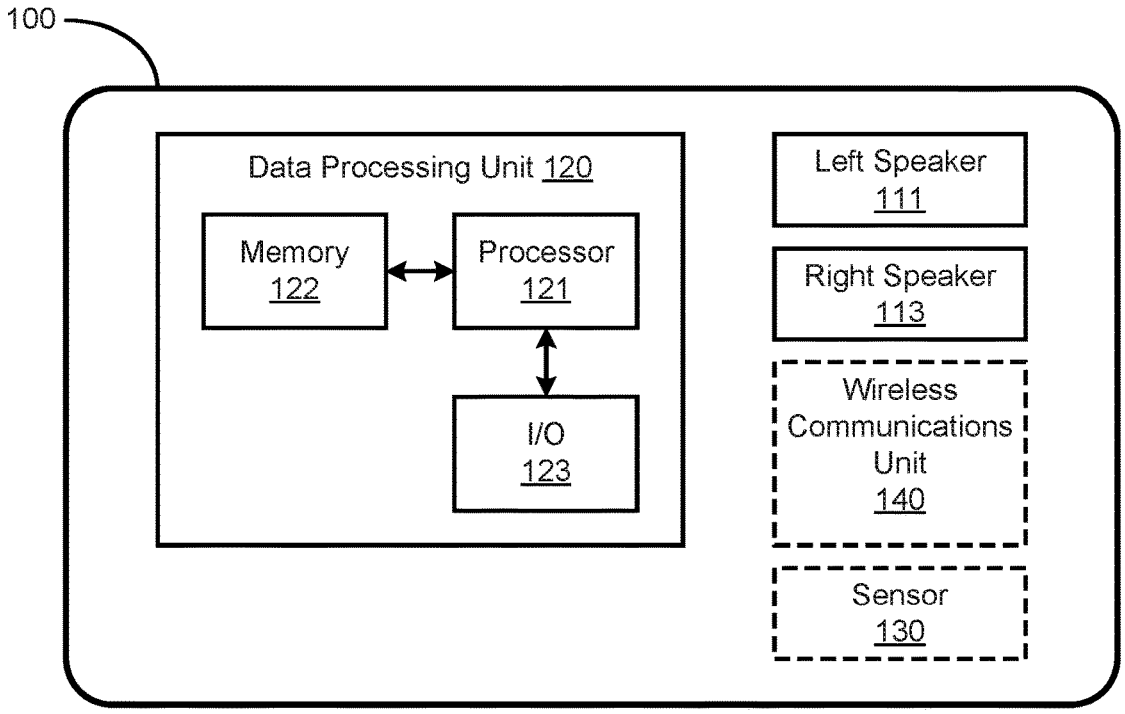
FIG. 1B shows a diagram of an example embodiment of a binaural audio device in accordance with the present technology.

FIG. 1B shows a diagram of an example embodiment of the binaural audio device 100 that embodies at least some of the devices of a binaural spatial audio processing system in accordance with the present technology. In the example embodiment shown in FIG. 1B, the binaural audio device 100 includes a left speaker 111 and a right speaker 113 to project the synthesized audio output of the device 100 for the listener. The binaural audio device 100 includes a data processing unit 120 in communication with the left speaker 111 and right speaker 113 to control the projection of the binaural audio output signals to the two speakers to produce distinct binaural audio sounds for each speaker.

In the example embodiment shown in FIG. 1B, the data processing unit 120 includes a processor 121 to process data, a memory 122 in communication with the processor 121 to store data, and an input/output unit (I/O) 123 to interface the processor 121 and/or memory 122 to other modules, units or devices of the system 100, device 100 or external devices. For example, the processor 121 can include a central processing unit (CPU) or a microcontroller unit (MCU). For example, the memory 122 can include and store processor-executable code, which when executed by the processor 121, configures the data processing unit 120 to perform various operations, e.g., such as receiving information, commands, and/or data, processing information and data, and transmitting or providing information/data to another device. In some implementations, the data processing unit 120 can transmit raw or processed data to a computer system or communication network accessible via the Internet (referred to as 'the cloud') that includes one or more remote computational processing devices (e.g., servers in the cloud). To support various functions of the data processing unit 120, the memory 122 can store information and data, such as instructions, software, values, images, and other data processed or referenced by the processor 121. For example, various types of Random Access Memory (RAM) devices, Read Only Memory (ROM) devices, Flash Memory devices, and other suitable storage media can be used to implement storage functions of the memory 122.

In some embodiments, the data processing system 150 includes one or more computing devices in the cloud, e.g., including servers and/or databases of the data processing system 150 in communication with other servers and databases in the cloud. In some implementations, the computing devices of the data processing system 150 include one or more servers in communication with each other and one or more databases. In the example cloud-based embodiments, the data processing system 150 is in communication with the data processing unit 120 of the binaural audio device 100. In some implementations, for example, the data processing unit 120 is resident on a user device, such as a smartphone, tablet, smart wearable device, etc., to receive and manage processing and storage of the data from the data processing system 150. Whereas, in some implementations, the data processing unit 120 is resident on the wearable, portable headphones or as a separate device in communication with standalone speakers.

In some embodiments, the data processing unit 120 of the binaural audio device 100 manages some or all of the data processing performed by the data processing system 150. For example, the data processing unit 120 of the device 100 is operable to store and/or obtain the HRTFs from a database, select the appropriate HRTF based on the sound source to be simulated at the speakers 111, 113, and decouple and process the HRTFs for each ear, producing a new HRTF for the left ear and a new HRTF for the right ear.

In some embodiments, for example, the device 100 includes a wireless communications unit 140 to receive data from and/or transmit data to another device. In some implementations, for example, the wireless communications unit 140 includes a wireless transmitter/receiver (Tx/Rx) unit operable to transmit and/or receive data with another device via a wireless communication method, e.g., including, but not limited to, Bluetooth, Bluetooth low energy, Zigbee, IEEE 802.11, Wireless Local Area Network (WLAN), Wireless Personal Area Network (WPAN), Wireless Wide Area Network (WWAN), WiMAX, IEEE 802.16 (Worldwide Interoperability for Microwave Access (WiMAX)), 3G/4G/5G/LTE cellular communication methods, NFC (Near Field Communication), and parallel interfaces.

The I/O of the data processing unit 120 can interface the data processing unit 120 with the wireless communications unit 140 and/or a wired communication component of the device 100 to utilize various types of wireless or wired interfaces compatible with typical data communication standards. The I/O of the data processing unit 120 can also interface with other external interfaces, sources of data storage, and/or visual or audio display devices, etc. For example, the device 100 can be configured to be in data communication with a visual display and/or additional audio displays (e.g., speakers) of other devices, via the I/O, to provide a visual display, an audio display, and/or other sensory display, respectively.

In some embodiments, the binaural audio device 100 includes a sensor 130 to detect motion of the listener and provide the detected motion data to the data processing unit 120 for real-time processing. The sensor 130 can include a rate sensor (e.g., gyroscope sensor), accelerometer, inertial measurement unit, and the like. In some implementations, the detected motion data is processed, in real-time, by the binaural audio processing system to account for spatial changes of the listener with respect to the sound source.

In some other embodiments, the binaural audio device 100 can be configured as one or more speakers set up in an environment, such as a room, to play sounds produced by the audio source and modified by the system to create a binaural spatial aspect to the audio output. In such embodiments, the binaural audio device 100 includes binaural audio speakers that project direct sound waves based on the binaural audio processing.

Figure 1C:
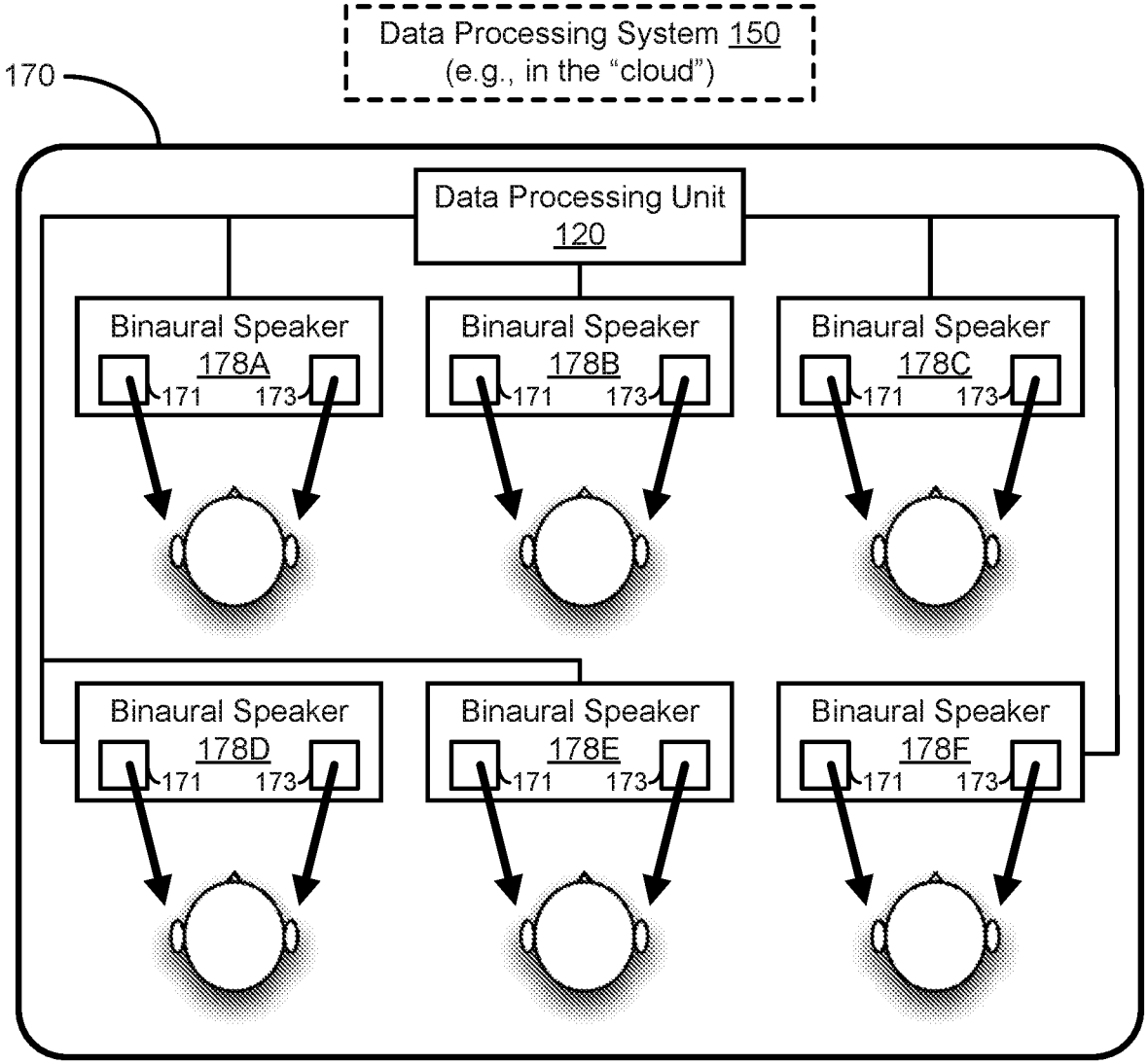
FIG. 1C shows a diagram of an example embodiment of a binaural audio processing system including an array of binaural speakers in accordance with the present technology.

FIG. 1C shows a diagram of an example embodiment of a binaural audio processing system in accordance with the present technology that includes a binaural audio device 170 in communication with a data processing system 150. In some embodiments, like that shown in the diagram of FIG. 1C, the binaural audio device 170 can be configured to include an array of binaural speakers 178 that project binaural audio signals as sound waves at individual users (listeners) to experience precise spatial effects to synthetic sounds produced by the audio source. In some implementations, each binaural speaker 178A, 178B, . . . 178*x* of the array includes a pair of left speakers 171 and right speakers 173 that project left sound waves and right sound waves, respectively, to create the binaural audio effect experienced by each of the users. In some embodiments, the binaural audio device 170 can be configured like the example of the binaural audio device 100 shown in FIG. 1B, but with a predetermined placement of the binaural speakers 178 of the array in an arrangement with respect to where uses would be positioned. In some examples, the binaural audio processing system that includes the array of binaural speakers 178 can be implemented in a theatre (e.g., movie theatre or performing arts auditorium, indoor or outdoor), arena, stadium, home theatre, or other venue to create the spatially precise sound effects for the content to be experienced by the user, such as a concert, movie, play, opera, musical, sporting event, etc. Notably, regular speakers can be arranged in various arrangements in the venue to project audio signals that are non-specific to any individual user, but in synchrony with the projected synthesized binaural audio output from the example binaural audio processing system, via binaural speakers 178, to create the spatially-precise sound effects associated with select sounds of the overall entertainment being experienced by the user at the venue. The example of FIG. 1C shows binaural speakers 178A, 178B, 178C, 178D, 178E and 178F arranged in front of the user, but it is understood that the array of binaural speakers 178 can be arranged in various arrangements, such as above, below, behind, etc. with respect to the user.

Figure 2A:
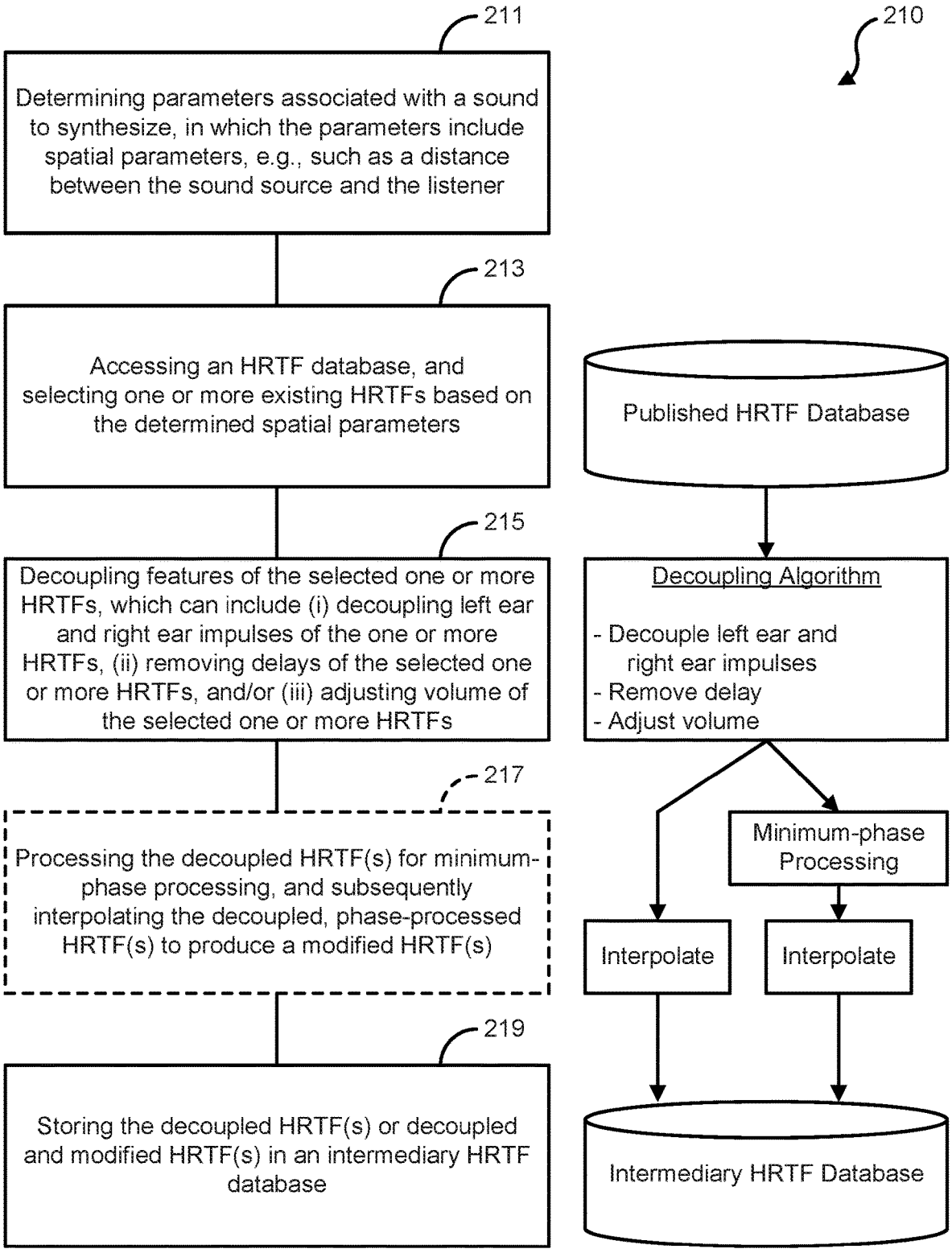
FIG. 2A shows a diagram of an example embodiment of a method for producing an intermediary HRTF in preparation for binaural audio signal processing in accordance with the present technology to create a spatially-precise sounding synthetic sound.
Figure 2B:
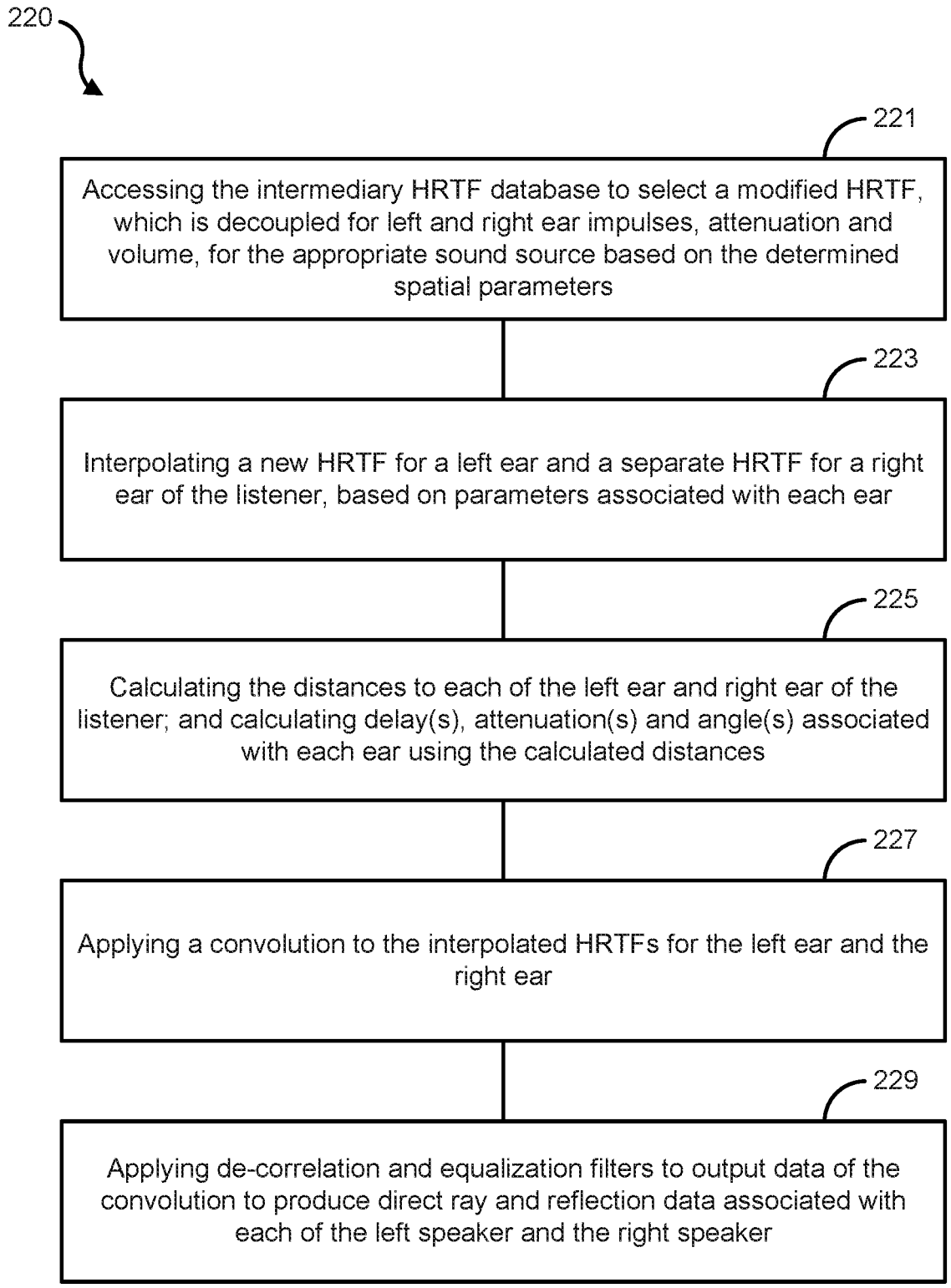
FIGS. 2B and 2C show diagrams of an example embodiment of a method for binaural spatial audio processing in accordance with the present technology.
Figure 2C:
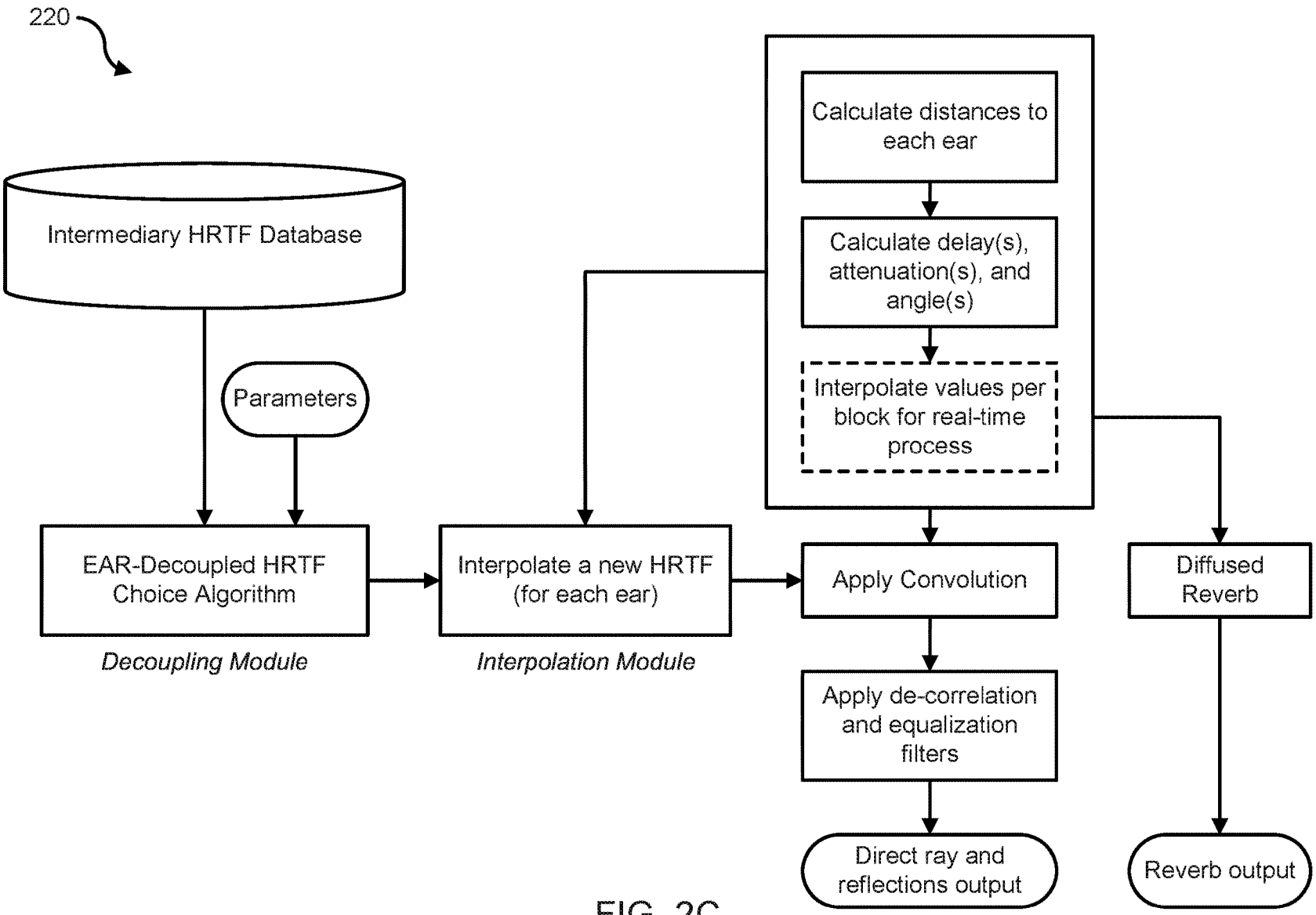

FIGS. 2A-2C show diagrams of an example embodiment of a method for binaural spatial audio processing in accordance with the present technology. The method can be implemented by various embodiments of the binaural audio processing system, including portable embodiments, non-portable embodiments such as setup in a room (e.g., public theatre or home theatre), and pseudo-portable embodiments. The method can be embodied by a digital signal processing algorithm stored and implemented by the various embodiments of the binaural audio processing system.

FIG. 2A shows a diagram illustrating a method 210 for producing an intermediary HRTF in preparation for binaural audio signal processing to create a spatially-precise sounding synthetic sound. The method 210 includes a preparation of one or more existing HRTFs from a database (e.g., such as published stereo binaural/HRTF databases, or private HRTF database allowing access) by generating left- and right-ear decoupled HRTFs to be entered in an intermediary HRTF database, which is a proprietary database of the disclosed system, also referred to herein as a "cooked" database. The diagram of FIG. 2A shows a process flow chart of the method 210 illustrated alongside a block diagram that depicts the flow of data and data structures between databases and computing entities executing data processing algorithms for implementing the method 210.

The method 210 includes, at process 211, determining parameters associated with a sound to synthesize, in which the parameters include spatial parameters, e.g., such as a distance between the sound source and the listener. The method 210 includes, at process 213, accessing a HRTF database, which can include accessing a published HRTF database or a private, proprietary database with existing HRTFs stored within; and selecting one or more HRTFs based on the determined spatial parameters. The method 210 includes, at process 215, decoupling features of the selected one or more HRTFs, which can include (i) decoupling left ear and right ear impulses of the one or more HRTFs, (ii) removing delays of the selected one or more HRTFs, and/or (iii) adjusting volume of the selected one or more HRTFs, e.g., to adjust for attenuation factors. In some implementations, the method 210 includes interpolating the decoupled HRTF or HRTFs to produce a modified HRTF or HRTFs. In some implementations, the method 210 optionally includes, at process 217, processing the decoupled HRTF or HRTFs for minimum-phase processing, and subsequently interpolating the decoupled, phase-processed HRTF or HRTFs to produce a modified HRTF or HRTFs. The method 210 includes, at process 219, storing the decoupled and modified HRTF or HRTFs (or the decoupled HRTF(s)) in an intermediary HRTF database, also referred to as a "HRTF database for Space3D" and/or "cooked" database.

Customarily, HRTFs are recorded as stereo Impulse Response measurements of discrete locations. Such HRTF measurements are usually done in anechoic chambers (e.g., rooms with very little reverberations or reflections from its walls) and already include the ITD, ILD, and HRTF filter. These recorded HRTFs are compiled and maintained in databases, of which some are 'published' in that there is effectively unrestricted access to use these existing HRTFs (with certain limitations), and some of which may be privately-owned and accessed with certain permissions granted by the owner.

The method 210 provides preparatory steps for binaural audio signal processing to produce a spatially-precise synthetic sound with respect to a user (or group of users). Implementation of the process 211 determines information about the distance of the sound source and the listener, which can be used as input in the process 213 for the selection of appropriate stereo impulse response measurements associated with an existing HRTF as part of the preparation. At the process 215, the example method 210 decouples the stereo HRTF measurements for the left and right ear and recalculates new HRTFs for the simulated direct rays, reflections and the diffusion sound for each ear based on the desired spatial location.

Interpolation of HRTFs can be done with various techniques. For example, linear interpolation of HRTFs will introduce phase cancellations and will cause flutter in the synthesized signal when the source is moving. Using the minimum phase version of the HRTF can allow for use of linear interpolation with no phase cancellation; however, the phase information lost during the minimum phase filtering can diminish the realistic quality of the synthesized sounds. In the example method 210, two types of interpolation (e.g., complex and minimum phase) can be used to create an intermediary "cooked" database from the different available databases. The "cooked" database has very high resolution quantization of space, and it allows for using linear interpolation without any phase cancellation problem. Before the complex or minimum phase interpolation is applied, the method 210 first decouples the left ear and the right ear impulse and removes the delay associated with the distance between the measured source and the respective ear from the HRTFs. The volumes of the HRTFs may also be adjusted for the attenuation associated with such delays.

FIG. 2B shows a diagram of an example embodiment of a method 220 for synthesis of binaural audio output for a left ear and a right ear of a listener. The method 220 includes, at process 221, accessing the intermediary HRTF database ("cooked" database) to select the modified HRTF, which is decoupled for left and right ear impulses, attenuation and volume, for the appropriate sound source based on the determined spatial parameters. The method 220 includes, at process 223, interpolating a new HRTF for each of the listener, i.e., a left ear HRTF and a right ear HRTF, based on parameters associated with each ear of the listener, e.g., such as the calculated parameters associated with each ear from the process 211. The method 220 includes, at process 225, calculating the distances to each of the left ear and right ear of the listener; and calculating delay(s), attenuation(s) and angle(s) associated with each ear using the calculated distances. In some implementations, the process 225 can further include interpolating values per block, e.g., which can be used in real-time processing. For example, the x, y, z distance data calculations can be down-sampled to a control rate synchronized substantially to the audio signal rate, e.g., by considering only the last coordinate in every block, after which the process can interpolate the delay times and attenuation factors within each block. In some implementations of the method 220, the calculated delay(s), attenuation(s) and angle(s) are inputs to the process 223 of interpolating a new HRTF for the left ear and a separate new HRTF for the right ear. The method 220 includes, at process 227, applying a convolution to the interpolated HRTFs for the left ear and the right ear. In some implementations of the method 220, the interpolated values per block from the process 225 are inputs to the convolution process 227 of the new interpolated, separate HRTFs. The method 220 includes, at process 229, applying de-correlation and equalization filters to the output data of the convolution to produce direct ray and reflection data associated with each speaker (e.g., left speaker 111 and right speaker 113), constituting a binaural audio output of the system. In some embodiments, where not all the reflections are synthesized, the method 220 optionally includes a process for adding diffused reverb, such as in applications of the method for real-time processing.

FIG. 2C shows a block diagram illustrating the flow of data and data structures among the intermediary HRTF database and computing entities executing data processing algorithms for implementing the method 220 for synthesis of binaural audio output for a left ear and a right ear of a listener. The diagram shows the selected HRTFs from the intermediary HRTF database ("cooked" database) is inputted to a decoupling module of a computing device, e.g., data processing unit 120 and/or data processing system 150, operable to execute an Ear-Decoupled HRTF Choice algorithm that, when executed, decouples the left and right ear impulses, attenuation and volume for the sound source based on the determined spatial parameters. The computing device processes the decoupled information, along with calculated parameters associated with each ear of the listener, at an interpolation module to interpolate the left ear HRTF and separate right ear HRTF. The computing device applies a convolution process to the interpolated HRTFs for the left ear and the right ear, which can include receiving interpolated values per block as inputs to the convolution process. The computing device applies de-correlation and equalization filters to the output data of the convolution module to produce direct ray and reflection data associated with the left speaker 111 and right speaker 113, which are provided as the binaural audio output to control the output of the speakers 111, 113.

Figure 3:
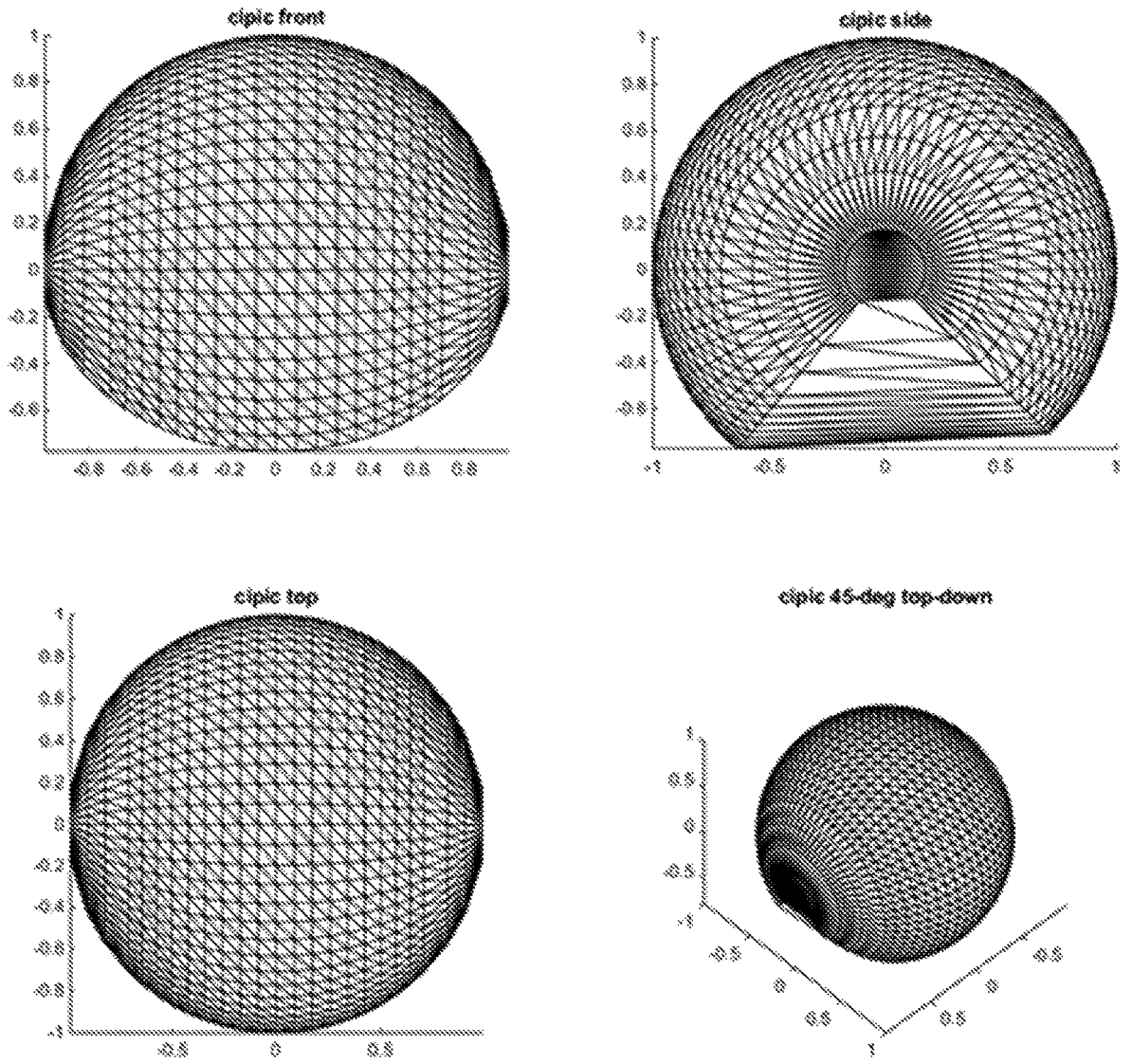
FIG. 3 shows a visualization diagram of locations corresponding to example HRTF measurements stored in an existing HRTF library, e.g., the CIPIC library.

FIG. 3 shows a visualization of measured locations from an example HRTF database made available by the CIPIC Interface Lab (http://interface.cipic.ucdavis.edu/sound/hrtf.html). The example visualization of FIG. 3 depicts the location of HRTFs stored in the CIPIC Interface Lab database, which is presently publicly available. Each intersection point of the lines in the visualization correspond to an HRTF associated with that particular location. The listener's location in the diagram is at 0, 0, 0, which corresponds to the center of the user's head which is approximately between the listener's left and right ears. Implementations of the process 213, for example, can include obtaining one or more HRTFs from the CIPIC Interface Lab database based on determined spatial parameters from the process 211.

Figure 4:
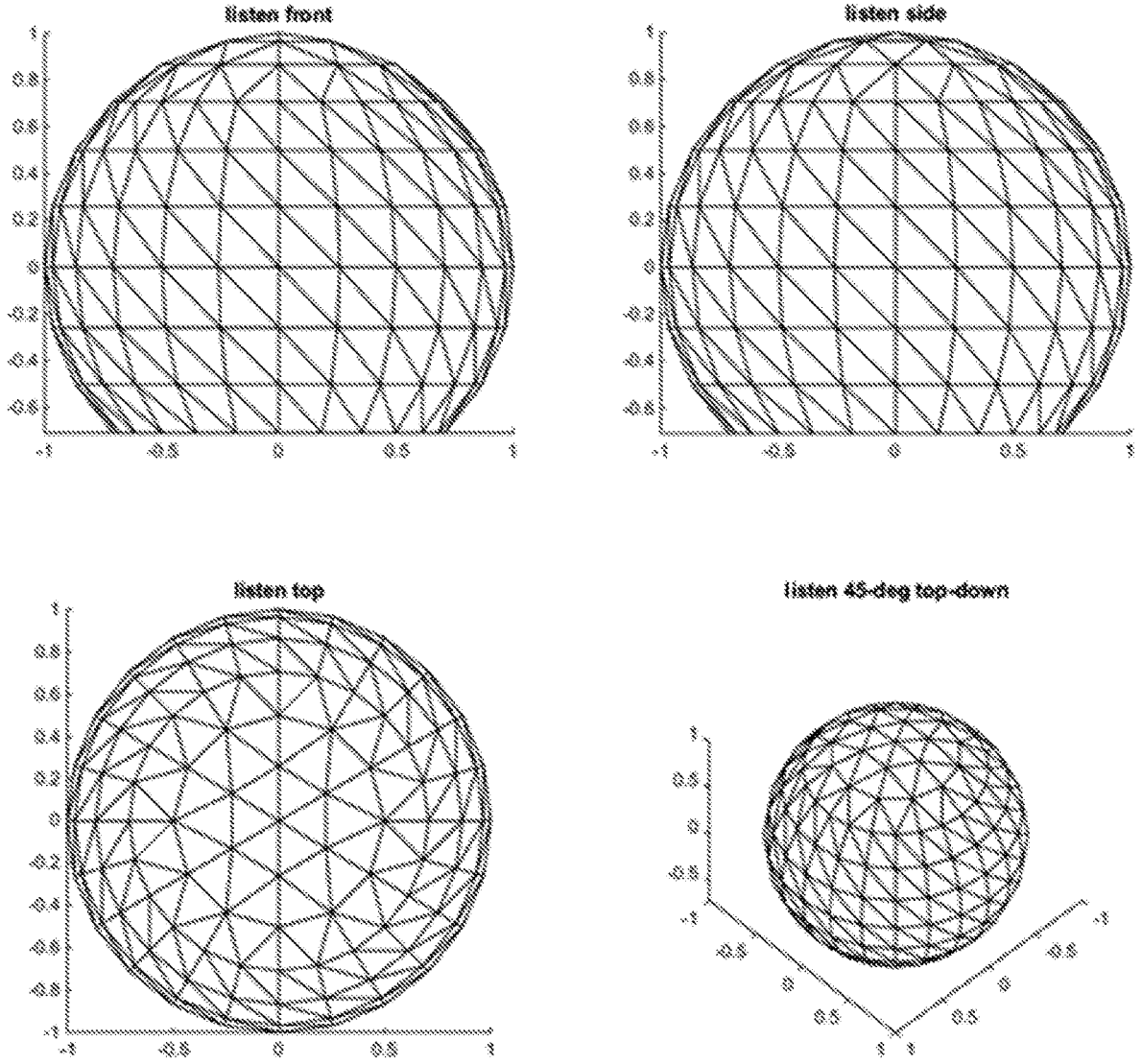
FIG. 4 shows another visualization diagram of locations corresponding to example HRTF measurements stored in an existing HRTF library, e.g., the Institute for Research and Coordination in Acoustic and Music (IRCAM) LISTEN library.

FIG. 4 shows a visualization of measured locations from another example HRTF database made available by the Institute for Research and Coordination in Acoustic and Music (IRCAM). Similar to FIG. 3, the example visualization of FIG. 4 depicts the location of HRTFs stored in the IRCAM database, which is presently publicly available. Implementations of the process 213, for example, can include obtaining one or more HRTFs from the IRCAM database based on determined spatial parameters from the process 211.

Figure 5:
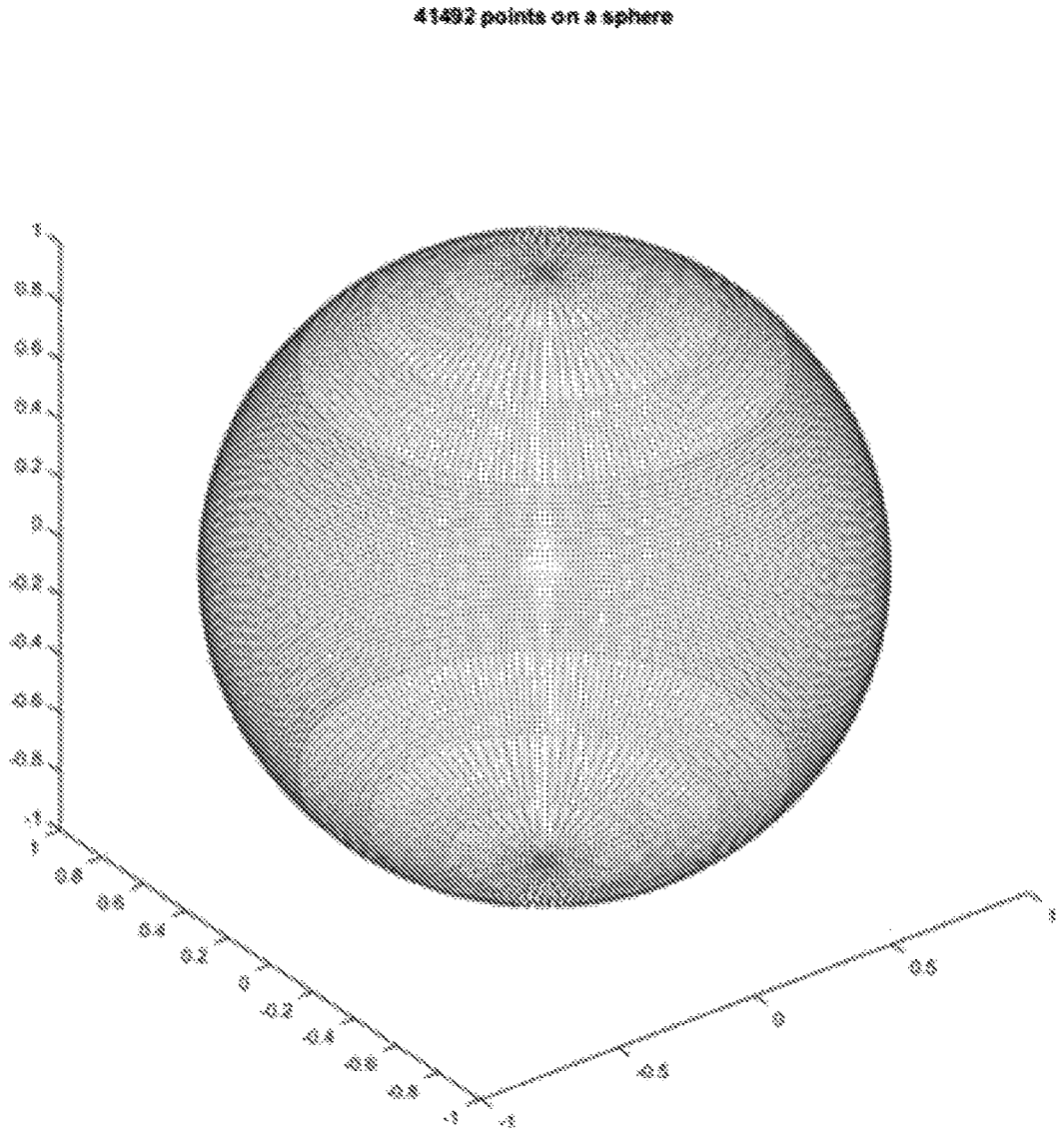
FIG. 5 shows a visualization diagram of the locations corresponding to modified HRTFs stored in an intermediary HRTF library in accordance with the present technology.

FIG. 5 shows a visualization diagram 500 of the locations corresponding to modified HRTFs stored in an intermediary HRTF library in accordance with the present technology. The locations shown in the visualization diagram 500 and modified HRTFs were re-created based on the implementation of the method 210 using the existing HRTF measurements from an existing HRTF database. The modified, intermediary database of HRTFs is also referred to as the "cooked" database. The intermediary HRTF database can be used for real-time synthesis of audio signals for an authentic, realistic binaural audio experience with spatial precision of synthesized sounds for listener.

The example visualization diagram 500 shows a graphical representation of locations, e.g., 41,492 point locations, where a left HRTF and a separate right HRTF is associated with that particular location at a given distance from each ear of the user.

Delay and Attenuation Factor Calculations

Example implementations of processes of the process 215 of the method 210 are described for (ii) removing delay and (iii) adjusting volume and/or attenuation factors of the selected HRTF. In some implementations, for example, based on the location of the virtual sound source, the size of the head of the listener, and the geometry of the virtual acoustic setting (e.g., room), a ray-tracing algorithm is used to calculate the direct and reflected rays to the ears of the listener. Direct paths are straight lines to the ears. Other than continuous control over the location of the source, three other parameters are defined to characterize the diffusion pattern of the sound source. Thus, the radiation vector (RV) is defined as follows:

$$RV=(x,y,z,\Theta,\varphi,\text{amp},\text{back}) \tag{3}$$

where x, y, and z denote the location of the source in the three dimensional virtual audio space, with (0,0,0) being at the center of the head, $\Theta$ is the azimuth of source radiation direction, $\varphi$ is the elevation of the source radiation direction, amp is the amplitude of the vector, and back is the relative radiation factor in the opposite direction of $\Theta$ and $\varphi$ ($0 \leq \text{back} \leq 1$). Back $\Theta$, and $\varphi$ are used to denote the supercardiod shape for radiation pattern of the sound source. Setting back to zero denotes a strongly directional source and setting back to one denotes an omnidirectional source.

The following equation is used to calculate the amplitude scale factor for a simulated sound ray:

$$r(\theta_r, \varphi_r) = \left[1 + \frac{(\text{back} - 1) * \delta}{\pi}\right]^2 \tag{4}$$

where $r(\theta_r, \varphi_r)$ is the scale factor, $\theta_r$ and $\varphi_r$ are the azimuth and elevation direction of the ray being simulated, and $\delta$ is the angle difference between the radiation vector of the source and the direction vector of the source being simulated.

Subsequently, the final attenuation factor for each simulated sound ray is calculated based on the following equations:

$$\alpha_i = \varrho_i B_i D_i \tag{5}$$

$$D_i = \frac{1}{d_i^{\gamma}} \tag{6}$$

where $\alpha$ is the total attenuation factor, $\varrho$ is the amplitude scalar determined based on the radiation pattern of the sound source and the angle by which the sound ray leaves the source (see Eq. 4), B accounts for absorption at reflection points, D is the attenuation factor due to the length of the path calculated based on d, the distance that the ray has to travel, and $\gamma$ denotes the power law governing the relation between subjective loudness and distance.

The delay values for each simulated sound rays is calculated by the relation:

$$\tau_i = \frac{R \times d_i}{c} \tag{7}$$

where $\tau$ is the delay value, R is the sampling rate in Hz, $d_i$ is the distance between the source and a speaker, and c is the speed of sound.

Example HRTF Ear-Decoupled Algorithm

Typically, for existing measured HRTFs, these HRTFs were created as either mono or coupled stereo recordings which include the delay, attenuation, and the filtration effect of the ear, the head and the body for the specific locations (e.g., depicted on the visualization diagram). The delay, attenuation and filtering effect of these HRTFs for each ear are related to the location for the measurement of the source. Therefore, in implementations of the method 210, for example, the selected existing HRTFs are processed to remove all such effects and decouple the existing HRTFs (e.g., in case of stereo recordings) so that the new intermediary ("cooked") HRTF set (i.e., a set including a left ear HRTF and a right ear HRTF) where the filtration effect of each ear, the head and the body can be used for synthesis process separately for each ear independently.

As such, the new intermediary HRFT set that includes a left ear HRTF and a right ear HRTF modified for each of the listener's ear are utilized in implementations of the method 220 for synthesizing binaural audio outputs for the left and right ears. For example, during the binaural audio output synthesis process, at least some or all of the effects (e.g., delay, attenuation and/or filtration) are reapplied to the direct ray, early reflections, and diffusion signal. Delay and attenuation values are calculated based on ray tracing of sound rays emitted from the source to each ear. This applies to both direct rays and early reflections. The HRTF values for a specific location are calculated based on the location of the desired spatial location to be synthesized and the available measured databases.

Figure 6A:
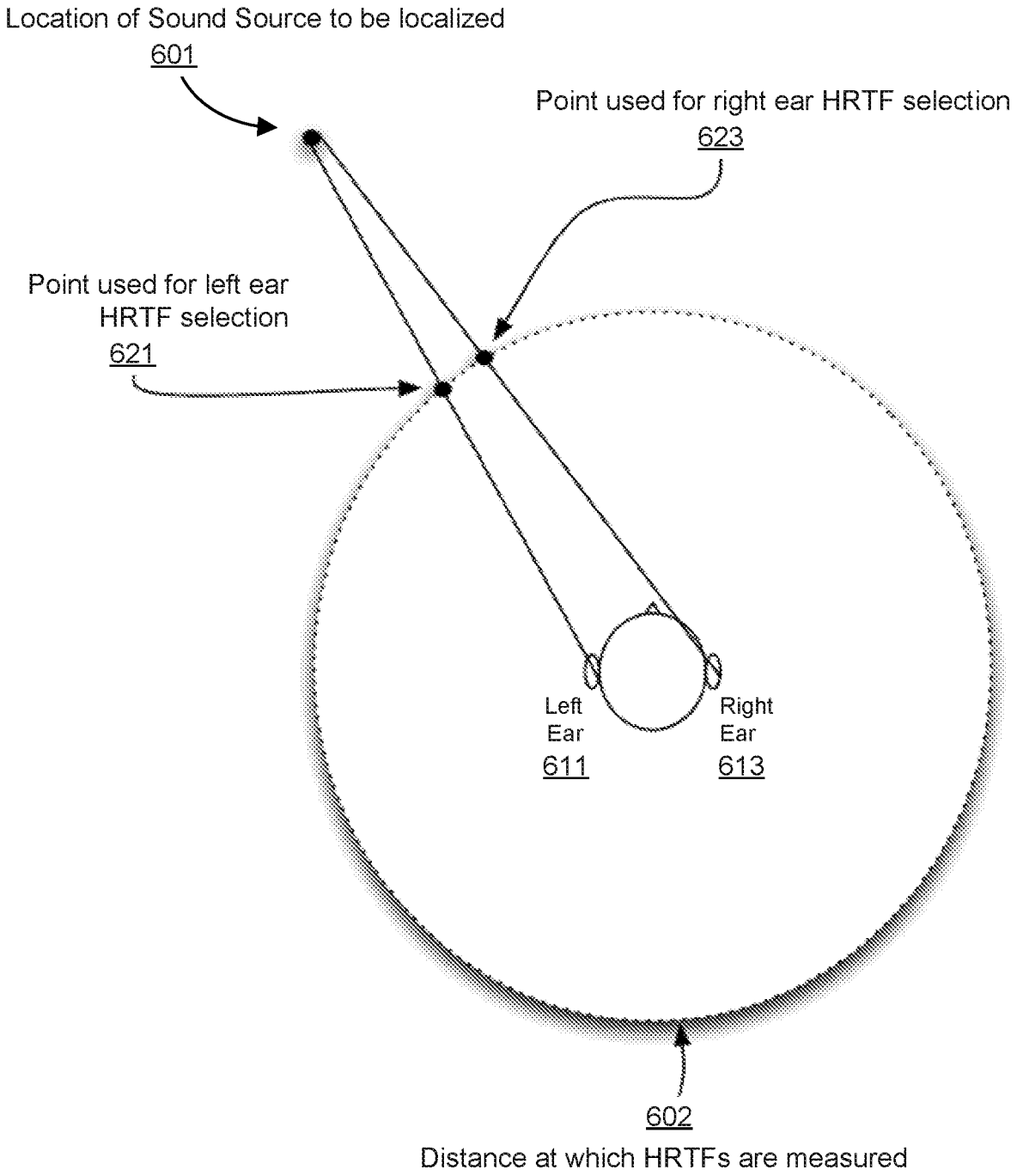
FIGS. 6A-6C show diagrams depicting an example implementation for determining how HRTFs are chosen for each ear on an example peripheral where sound source locations are farther than an HRTF measurement ring.

FIG. 6A shows a diagram depicting an example implementation for determining how HRTFs are chosen for each ear on an example peripheral (e.g., circle) where the HRTF selection measurements are determined when the locations of the sound source to be simulated are farther from the ears than the HRTF measurement ring. In this example, a sound to be simulated (e.g., a crashing sound of two object colliding) is specified in a media content to be at a certain location with respect to the listener experiencing the media content. The media content can be just audio media or a mix of visual and audio media, such as a TV, movie, or other multi-media content, which can be experienced using a regular display screen or a virtual or augmented reality (VR and/or AR) device. As shown in the example of FIG. 6A, a first direct ray is determined between the listener's left ear 611 and the location of the sound source 601; and a second direct ray is determined between the listener's right ear 613 and the location of the sound source 601. The first and second direct rays intersect the peripheral where the HRTFs have been measured at a distance 602 from the listener. The method 210 at process 213 selects a left HRTF associated with point 621 on the peripheral and a separate right HRTF associated with point 623 on the peripheral, which are subsequently prepared in accordance with the method 210 and stored in the intermediary "cooked" database. The intermediary HRTFs are then selected for further processing in accordance with the method 220 to produce the binaural audio signals to be rendered as actual sound at the left and right speakers 111, 113 of the device 100 that synthesizes the spatial effect of the synthetic sound (e.g., collision of objects) at the appropriate time with respect to the played media.

Figure 6B:
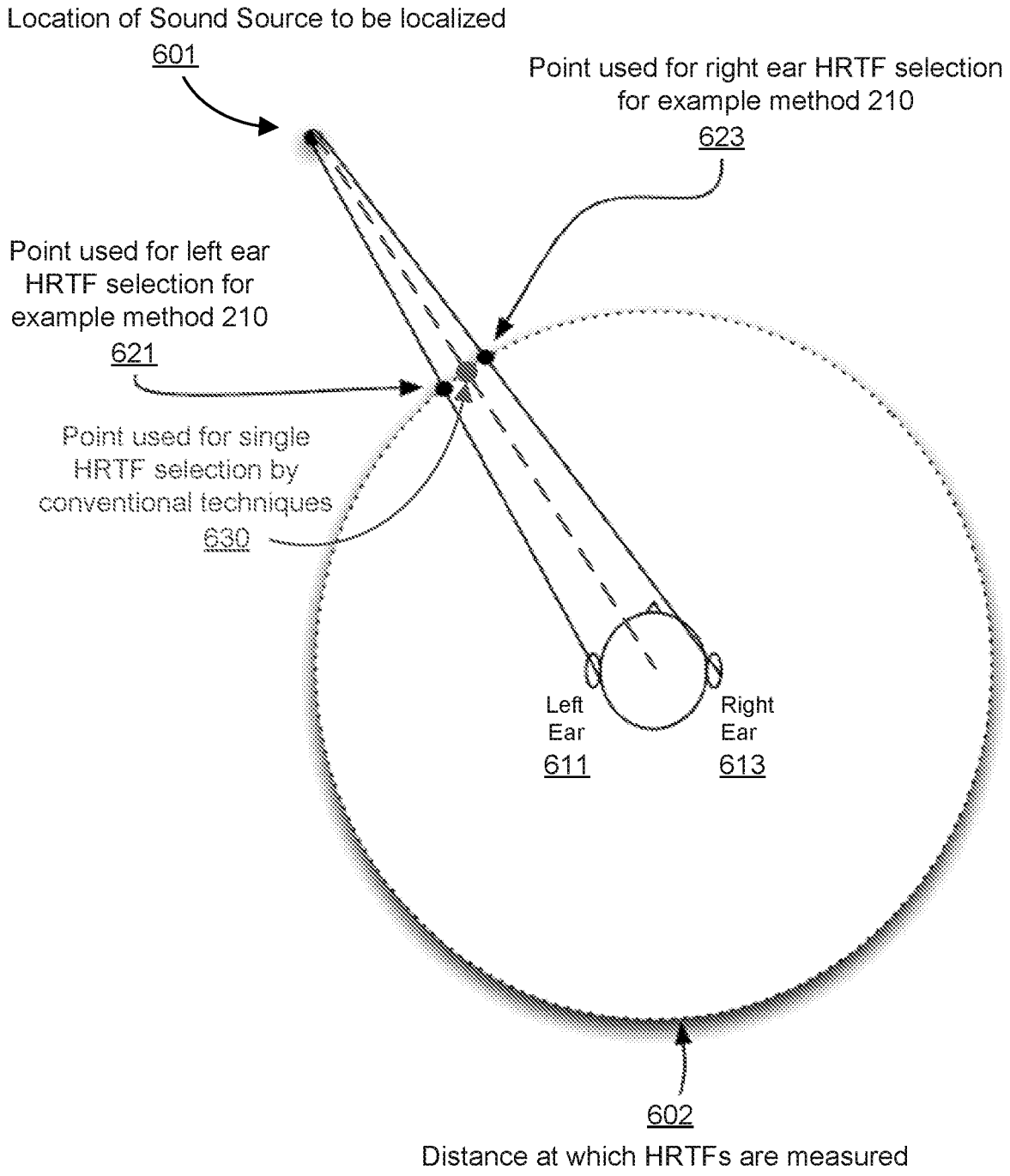

FIG. 6B shows a comparative diagram depicting different points where HRTFs are selected based on the method 210, like in FIG. 6A, and using a conventional technique that does account for each of the left ear and the right ear of the listener. Here, the selection of locations for HRTF calculation using the method 210 and a conventional technique are substantially different in this example situation when the location of the sound source 601 is farther away from the radius of the farthest measured HRTF database, i.e., the distance 602 of the peripheral. In such instances, a single, different HRTF is used by the conventional technique, which is imprecise of where the synthetic sound would be heard by the listener at each ear. Moreover, if the location of the sound source 601 was moved within the peripheral but along the same ray used in the conventional technique, this would still result in the same HRTF selected by the conventional technique, but very different HRTFs for the left ear and the right ear by implementation of the method 210.

Figure 6C:
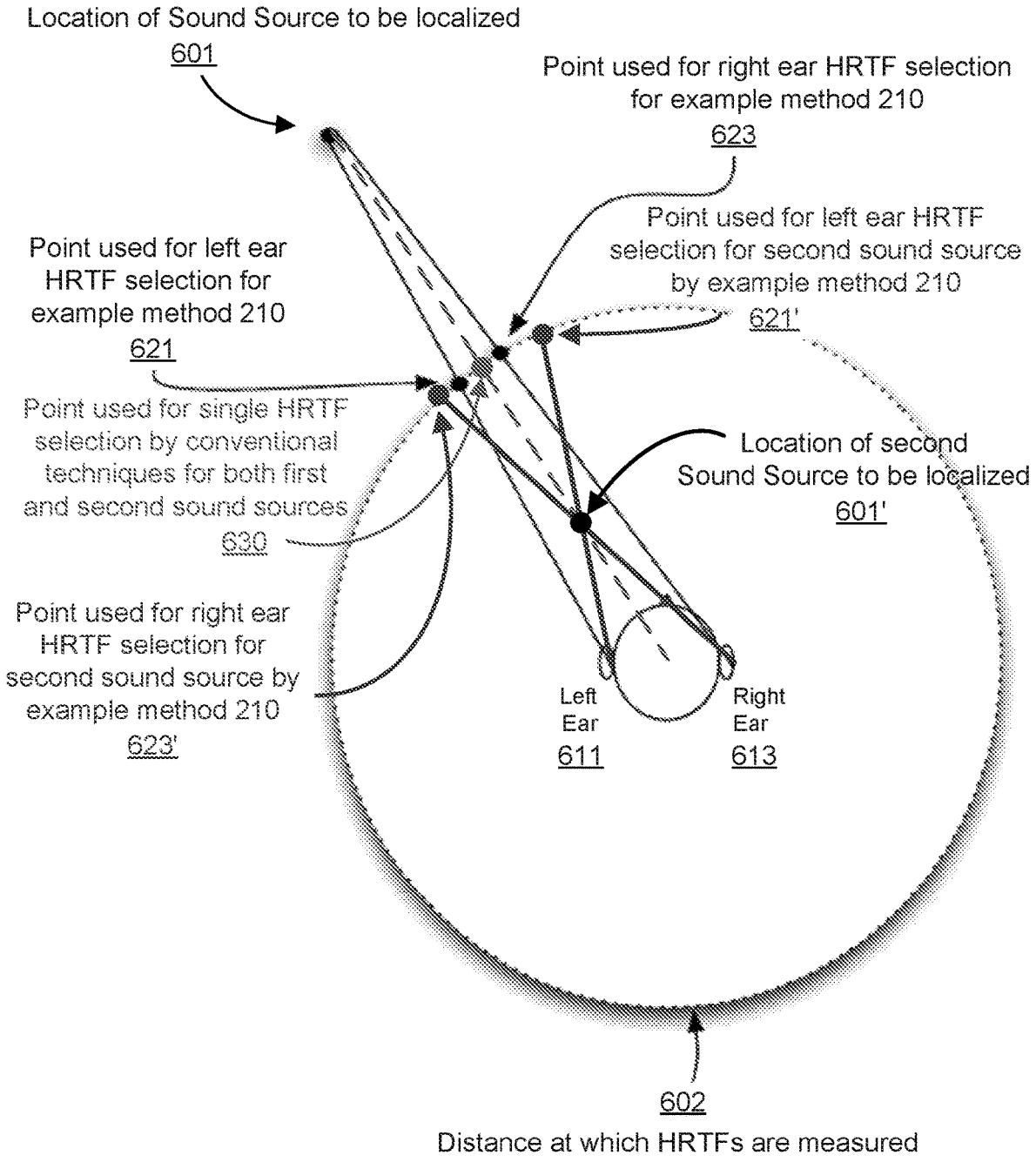

FIG. 6C shows this example where a second sound source located at location 601' is within the distance 602 where HRTFs are measured (e.g., within the peripheral) and along the same line as the ray drawn using a conventional HRTF selection technique. Here, the same HRTF would be selected using the conventional technique despite the different locations of the sound source at 601 and 601'. In contrast, implementation of aspects of the method 210 would produce different points on the peripheral corresponding to the left ear and the right ear, i.e., 621' and 623' respectively, which result in selection of a different left ear HRTF and a different right ear HRTF for the second sound source location 601' with respect to the first sound source location 601.

Figure 7A:
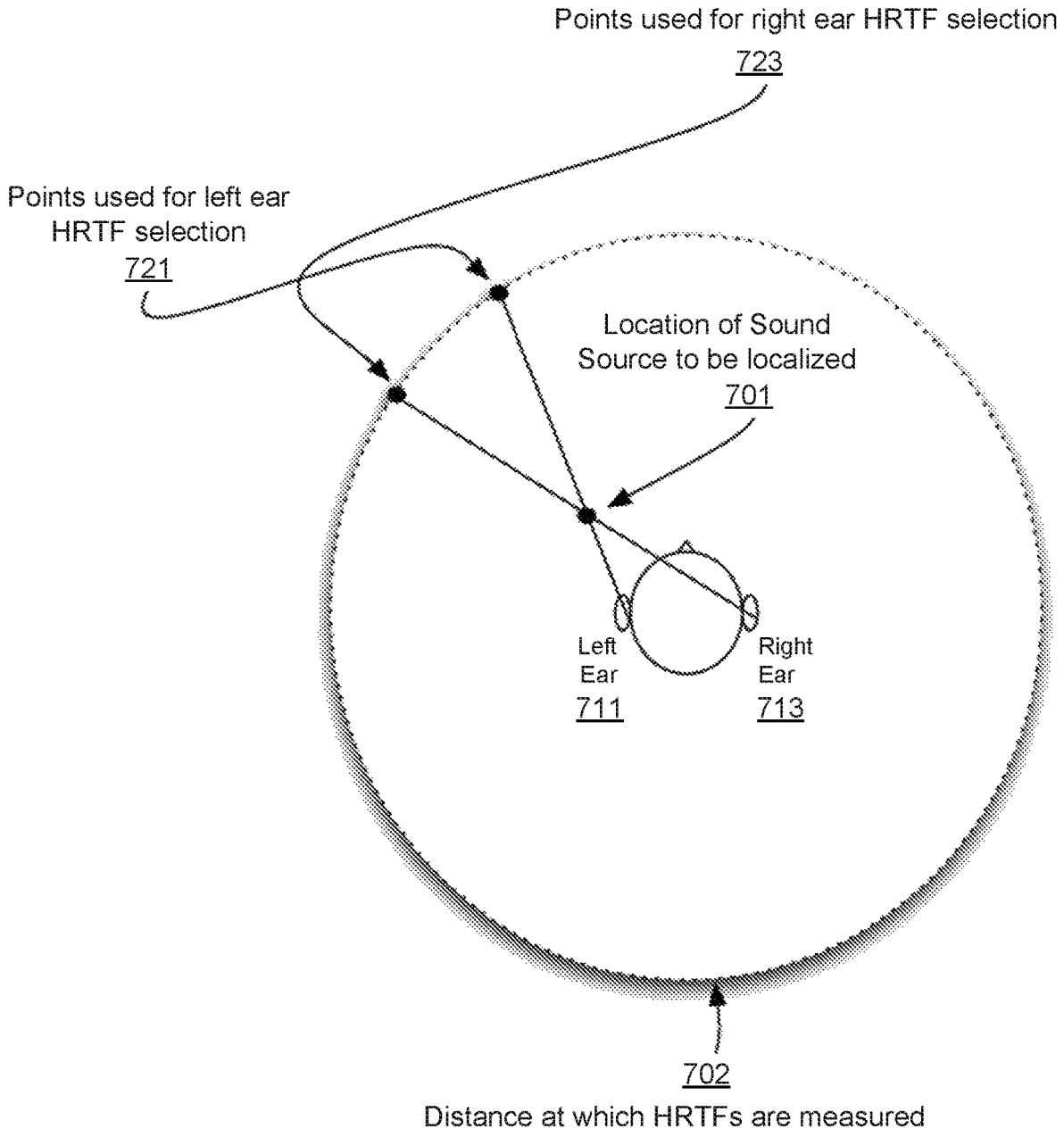
FIGS. 7A and 7B show diagrams depicting an example implementation for determining how HRTFs are chosen for each ear on an example peripheral where sound source locations are closer than an HRTF measurement ring.

FIG. 7A shows a diagram depicting another example implementation for determining how HRTFs are chosen for each ear on an example peripheral (e.g., circle) where the HRTF selection measurements are determined when the locations of the sound source to be simulated are closer to the ears than the measurement peripheral. In this example, a first direct ray is determined between the listener's left ear 711 and the location of the sound source 701; and a second direct ray is determined between the listener's right ear 713 and the location of the sound source 701. The first and second direct rays are drawn to extend past the location 701 to each intersect the peripheral distance 702 where HRTFs are measured. The method 210 at process 213 selects a left HRTF associated with point 721 on the peripheral and a separate right HRTF associated with point 723 on the peripheral, which are subsequently prepared in accordance with the method 210 and stored in the intermediary "cooked" database. The intermediary HRTFs are then selected for further processing in accordance with the method 220 to produce the binaural audio signals to be rendered as actual sound at the left and right speakers 111, 113 of the device 100 that synthesizes the spatial effect of the synthetic sound (e.g., collision of objects) at the appropriate time with respect to the played media.

Figure 7B:
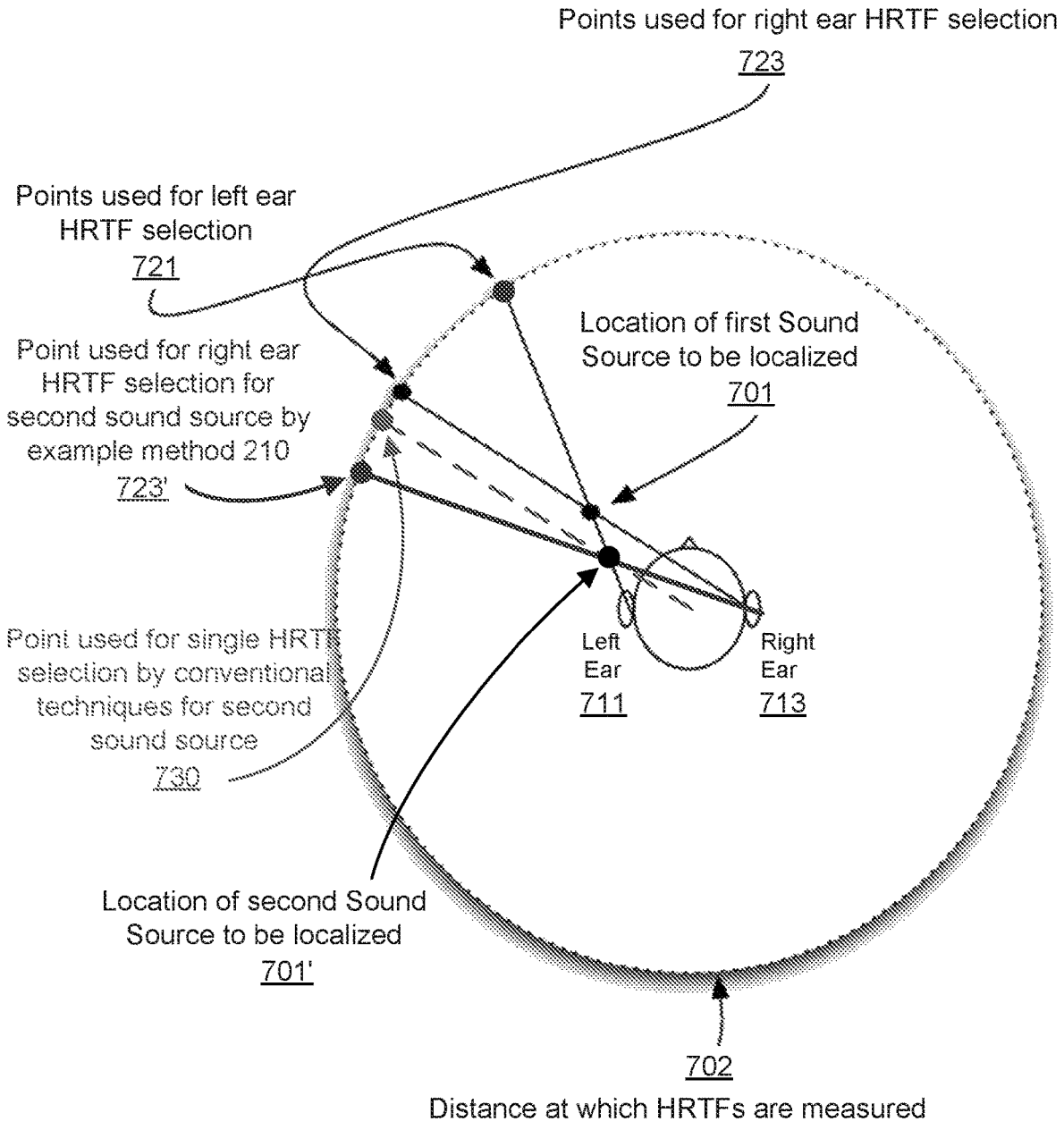

FIG. 7B shows a comparative diagram depicting different points where HRTFs are selected based on the method 210 in comparison with conventional techniques, where a second sound source located at location 701' is within the distance 702. In this example, the selection of location for HRTF calculation when the second sound source location 701' is even closer to the listener's head than the first sound source location 701 results in the same left ear HRTF since the point 721 does not change despite the movement of the location 701 to 701', but the right ear transfer function changes based on the different locations of point 723 and 723'. Notably, for this example, the HRTF selected using a conventional technique would result in different HRTFs for the change in locations of the first and second sounds, but would provide an inaccurate synthetic sound delivered in the left ear speaker 111 due to the imprecise location of the HRTF for both left and right ears, e.g., most dramatically for the left ear.

When such decoupling of HRTFs are used the spatial impression of binaural synthesis of audio signals are far more realistic specially when the virtual sound source are to be perceived very close to the ear or much farther from the head than the location where measured HRTFs are available. One of the main problems of binaural synthesis is that most synthesis methods are not able to externalize the synthesized sounds from the head of the listener. The disclosed methods are able to achieve far more externalization of the sound, for example, as compared to conventional methods that do not decouple of the HRTFs from each ear and the associated delay and attenuation values.

Example Implementations

Example implementations of binaural audio signal processing algorithms by example embodiments of the methods, systems and devices in accordance with the disclosed technology can be applied in a variety of use cases like the examples below.

Figure 8:
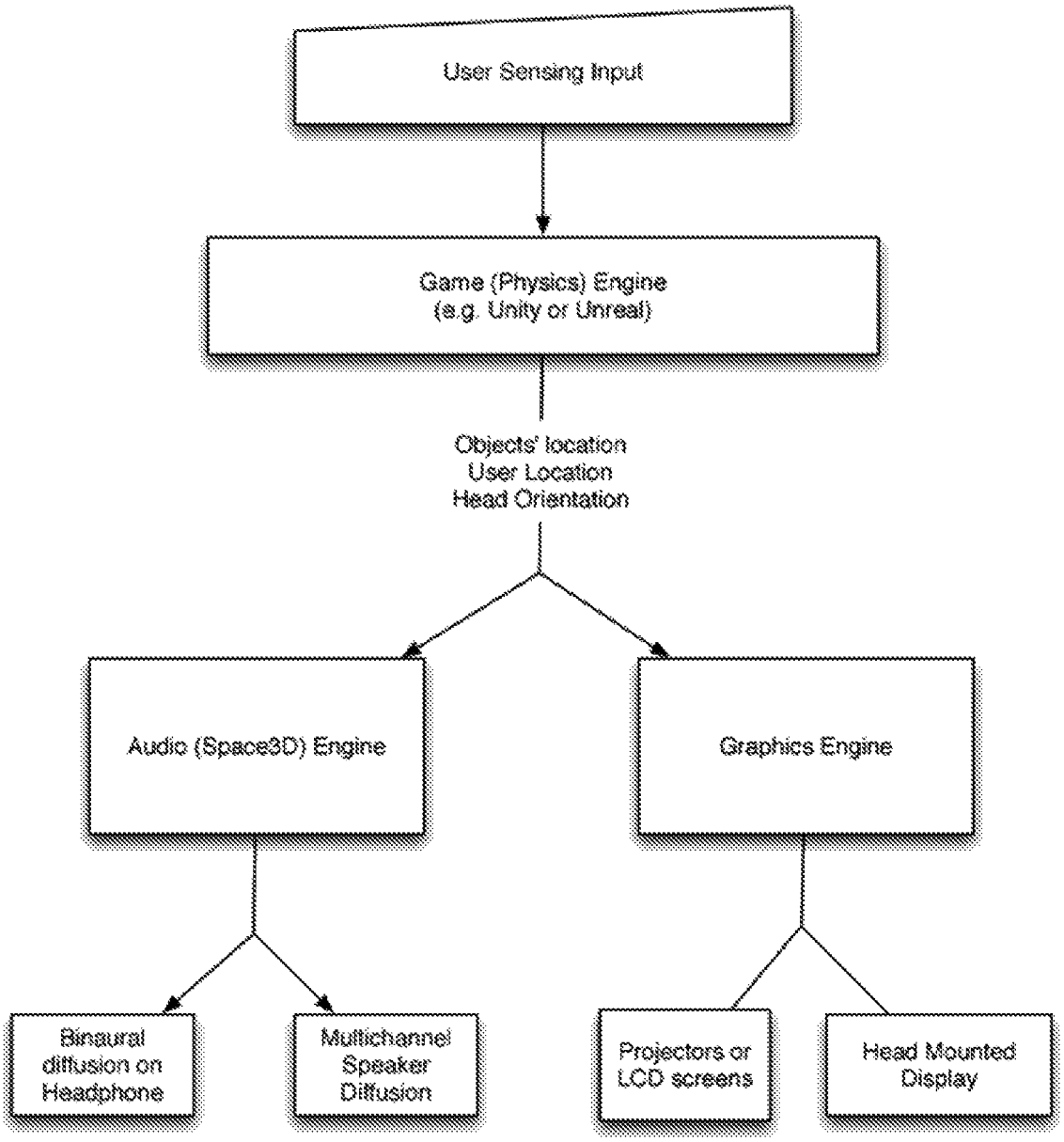
FIG. 8 shows a diagram depicting example application use cases of the disclosed technology in the context of virtual and augmented reality environments.

FIG. 8 shows a diagram depicting example application use cases of the disclosed technology in the context of virtual and augmented reality environments. For example, the system is capable of making binaural audio for use by headphones, or it can be used on multichannel playback over speakers, such as over 5.1 home theatre surround sound setup. In such examples, the binaural audio signal processing algorithm would be implemented as a plugin into a game engine (e.g., such Unity or Unreal), or it can be setup as an independent server.

For example, the game engine can execute the binaural audio signal processing algorithm for input data including a sensing unit that senses the listeners position with respect to the content being consumed (e.g., a VR or AR game or other content experience), such that the algorithm continuously updates the parameters associated with user (e.g., distance from the sound to be synthesized from each ear, head orientation, etc.) to select and prepare intermediary "cooked" HRTFs and subsequently decouple and process the intermediary HRTFs for producing the left ear- and right ear-specific binaural audio signals in real time to augment the audio experience during the presentation of the overall content. The diagram of FIG. 8 illustrates the production of the left ear- and right ear-specific binaural audio signals on a variety of auditory media platforms, including headphones or multi-channel speakers, which can be used in conjunction with a variety visual media platforms like a head mounted display or visual projectors or screens.

Figure 9:
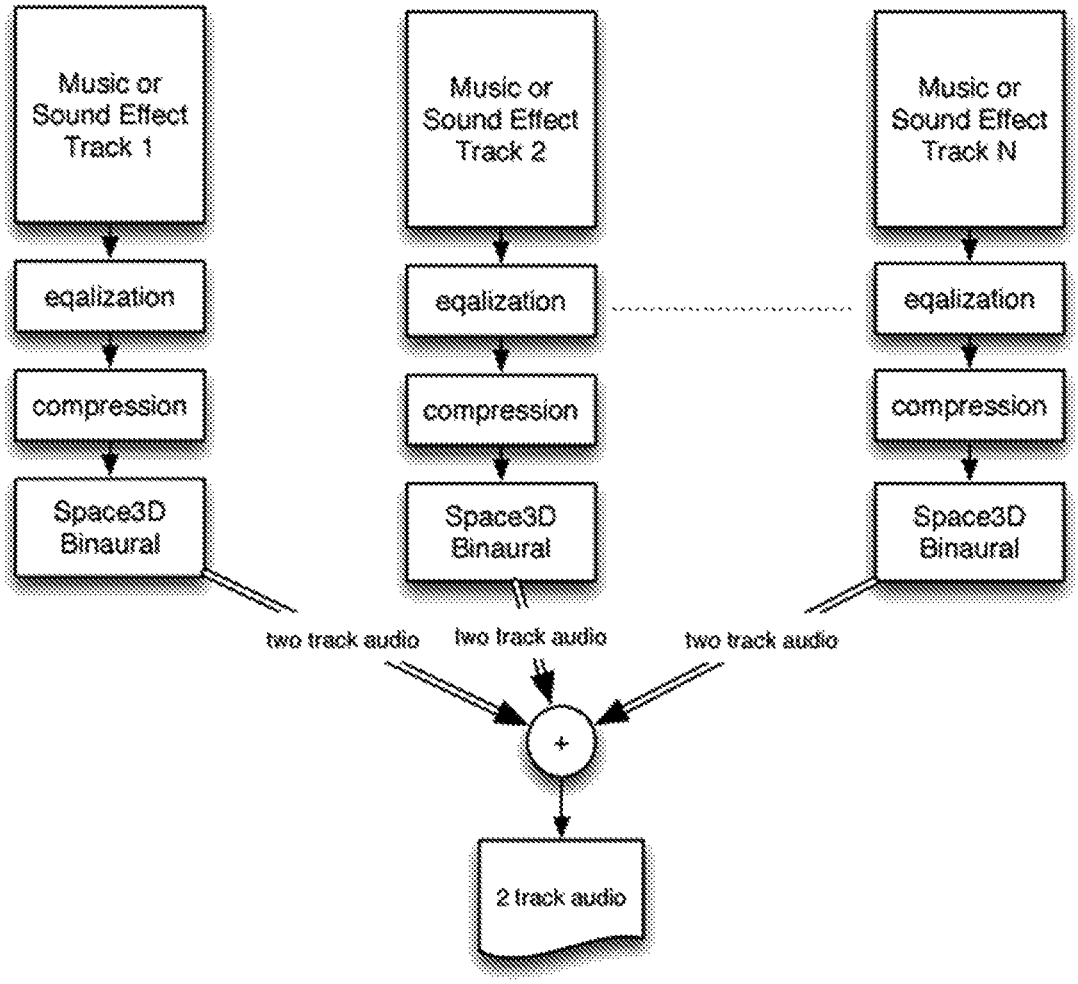
FIG. 9 shows a diagram depicting an example system used in a digital audio workstation as a plugin for creating spatialized musical material to be encoded in binaural format.

FIG. 9 shows a diagram depicting an example system for binaural audio processing that is used in a digital audio workstation as a plugin (e.g., such as VST or AU plugins) for creating spatialized musical material to be encoded in binaural format. In this case, for example every track representing a different sound source is being processed separately and can be positioned in a different spatial location. The position of all the sources can then be controlled in time separately. In this example, every track generates a separate stereo binaural output, all of which can be summed together to create a single stereo signal.

Figure 10:
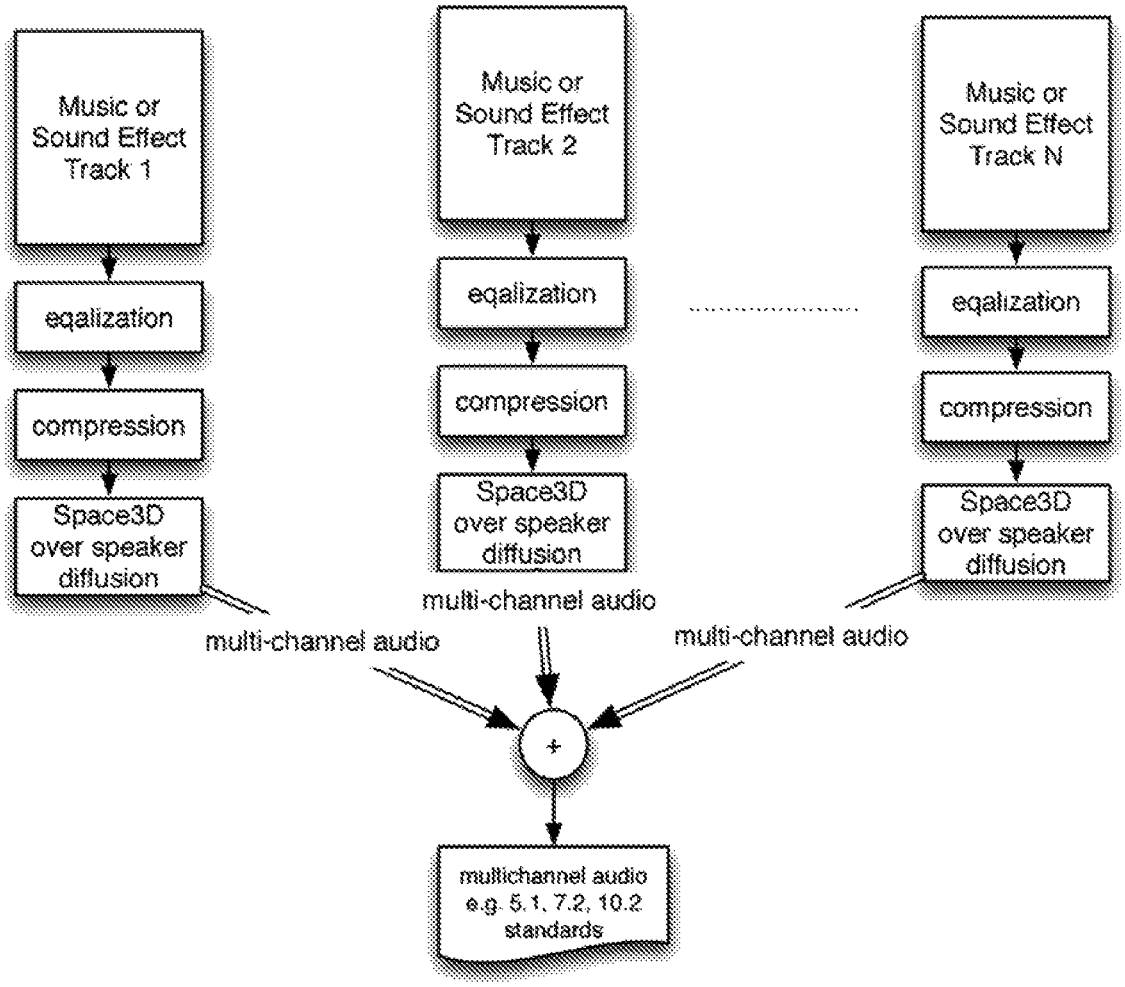
FIG. 10 shows a diagram depicting an example system used in a digital audio workstation as a plugin for creating spatialized musical material to be played back over a surround sound system playback setup.

FIG. 10 shows a diagram depicting an example system used in a digital audio workstation as a plugin (e.g., such as VST or AU plugins) for creating spatialized musical material to be played back over surround sound system playback setup, e.g., such as 5.1, 7.1, quad, etc. The plugins can be configured to produce binaural material based on the disclosed methods or multi-channel output to be diffused over multiple speakers. In the latter case, for example, all tracks generate multi-channel audio output which position each track in their own respective spatial location independently. All the multi-channel outputs for the tracks can be summed together at the end to produce one set of multi-channel output.

Figure 11:
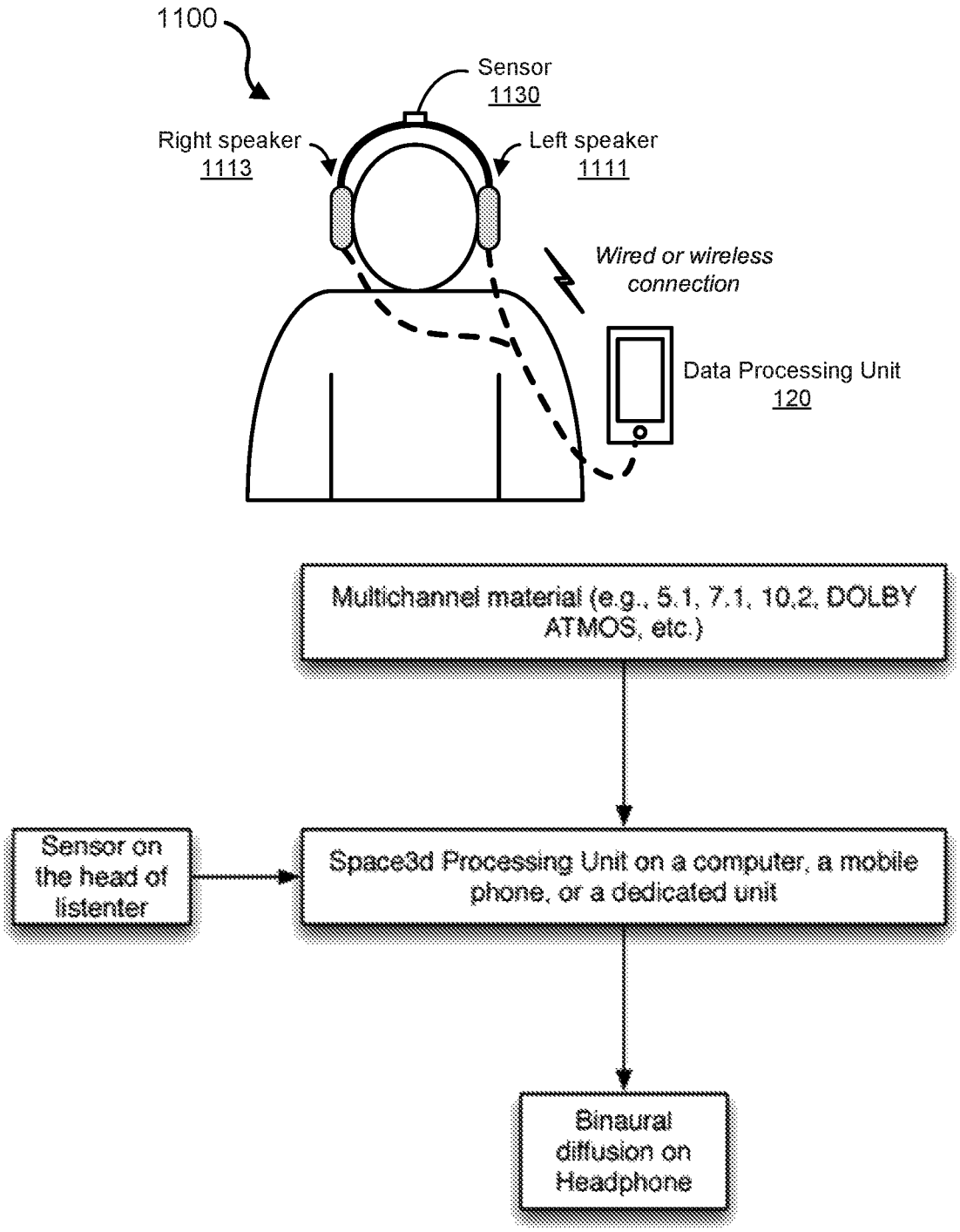
FIG. 11 shows a diagram depicting an example implementation of a binaural audio processing system using headphones.

FIG. 11 shows a diagram depicting an example implementation of a binaural audio processing system in accordance with the present technology using headphones which provides a binaural rendering of multichannel audio and receives head orientation information from a sensor on the head of the user. The diagram shows an example embodiment of the binaural audio device 1100, which can include the data processing unit 120 on the wearable device portion or in wired or wireless communication with the data processing unit 120 and/or data processing system 150 in the cloud. The example of the binaural audio device 1100 shown in FIG. 11 includes a portable pair of headphones a left speaker 1111 and right speaker 1113 and a sensor 1130 to monitor the user's head movement. In this example, the user can move his/her head and the sound world stays the same around the user. The example use case of FIG. 11 can provide a multichannel audio display (e.g., 5.1, 7.1, 10.2, DOLBY, ATMOS, etc.) with specific binaural audio output in a pair of headphones of the system while the user moves, in real time, which can simulate a virtual sound world using the multichannel audio and sensors from the user.

Figure 12:
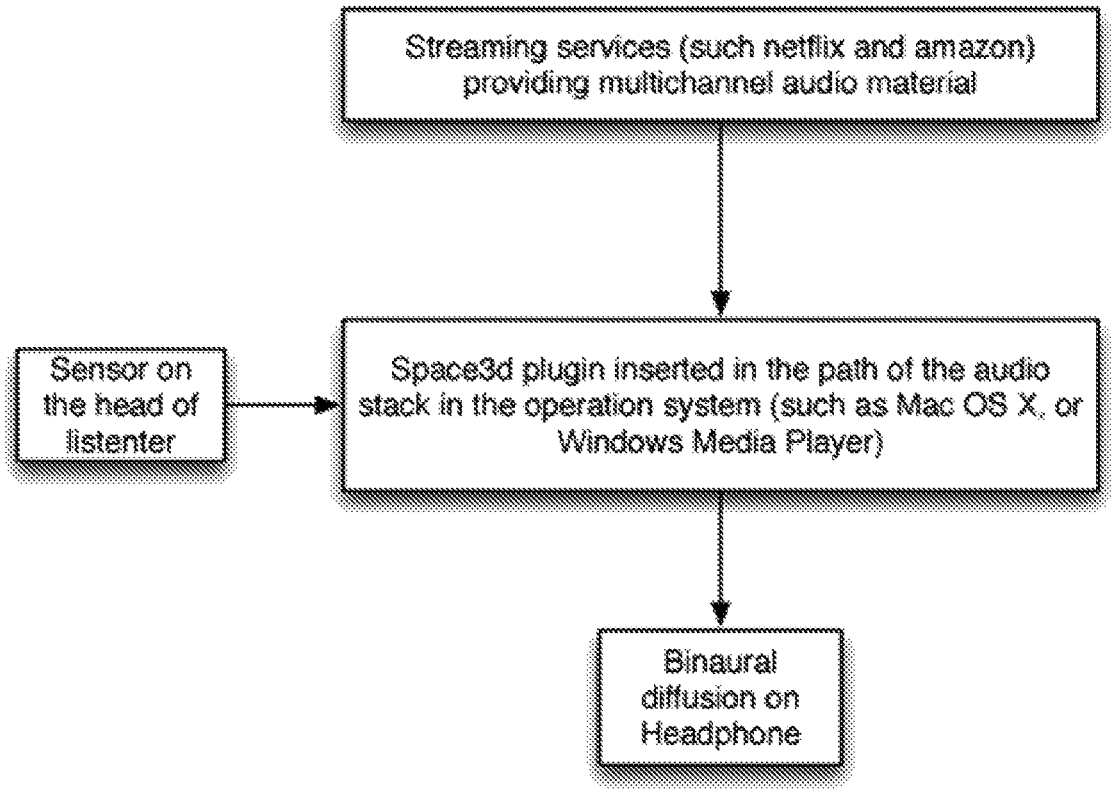
FIG. 12 shows a diagram depicting an example implementation of a binaural audio processing system used for making a binaural rendering of a stream of multichannel audio.

FIG. 12 shows a diagram depicting an example implementation of a binaural audio processing system used for making a binaural rendering of a stream of multichannel audio (e.g., in movies or music). Similar to the example binaural audio device 1100 shown in FIG. 11, the example system of FIG. 12 receives head orientation information from a sensor, such as sensor 130 of the example device 100 or sensor 1130 of example device 1100, on the head of the user. For example, the user can move his/her head and the sound world stays the same around the user. The system can include a plugin installed on an operation system of the computer, e.g., such as in Core Audio or on Windows Media Player or other, to process the user's motion and produce the spatial adjustments of the synthesized sounds by the system to be projected by the speakers. The example use case depicted in FIG. 12 can be used for binaural rendering of multichannel audio that is streamed over the Internet.

Spatialization Standards and Example Benefits

The disclosed binaural audio processing system is fully scalable. For example, the system can generate audio for any diffusion system (e.g., binaural on headphone, over speakers in small and large spaces), and it is possible to create a standard where fully rendered audio material is not distributed, but the source material, and the location of the objects, in relation to the orientation of the listener is used to render the audio at the point of consumption for the configuration of the consumption. For example, by implementing the systems and/or methods of the present technology, no longer a movie needs to have multiple mixes, such as one for home audio, one for theatrical showings, etc.

Figure 13:
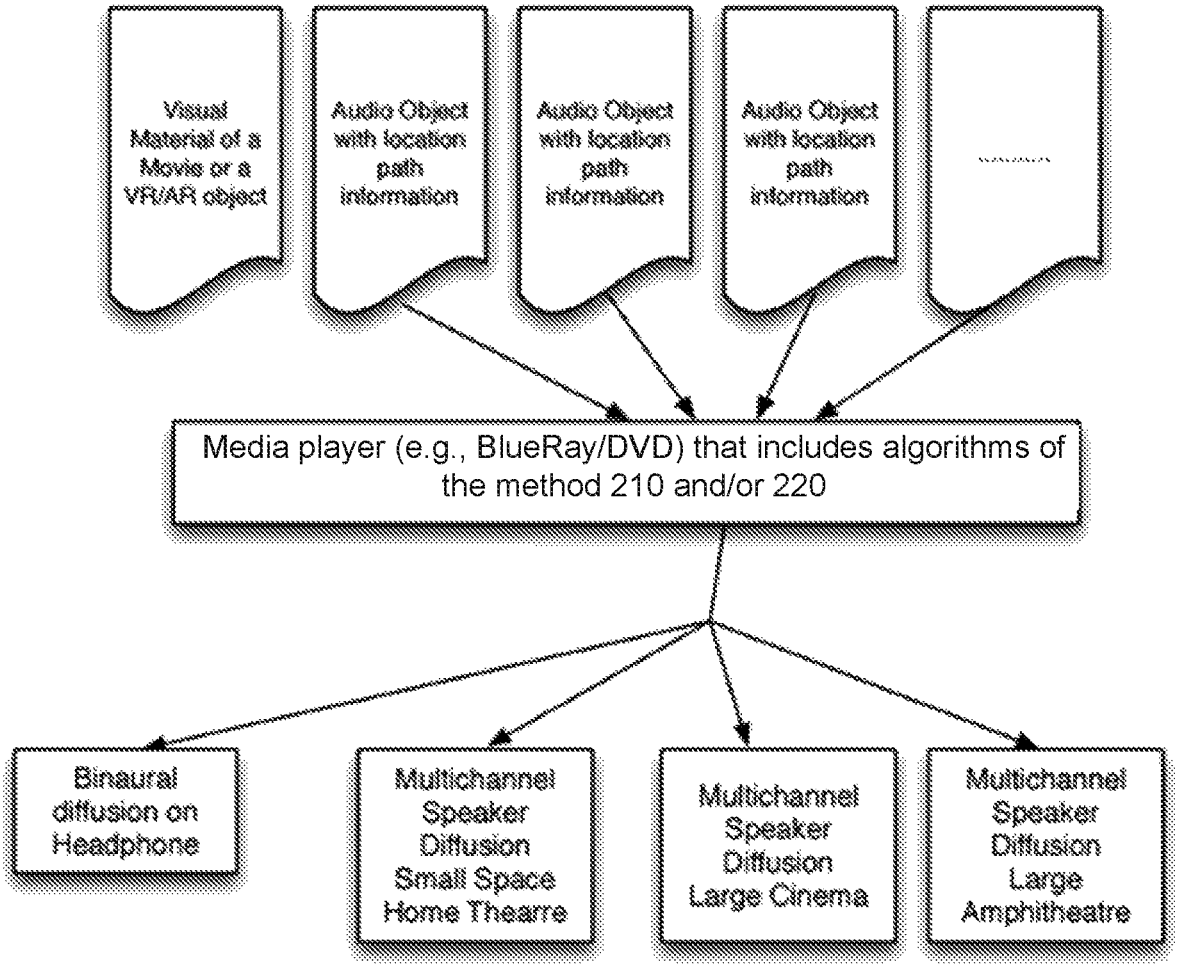
FIG. 13 shows a diagram of an example embodiment of the binaural audio processing system where the distributed data for a sound score is composed of the raw audio material and location information for that object.

FIG. 13 shows a diagram depicting an implementation of an example binaural audio processing method, where the distributed data for a sound score is composed of the raw audio material and location information for that object. The rendering happens at the consumption point, e.g., a media player such as on a BluRay or DVD player, or a projector in a movie theatre. The system, implementing the methods for binaural audio processing (e.g., digital processing algorithm) can create a standard for encoding of spatial information of sonic objects. The diagram of FIG. 13 illustrates the production of the left ear- and right ear-specific binaural audio signals on a variety of auditory media platforms, including headphones or multi-channel speakers of small, large or very large sizes and/or arrangements, which can be used in conjunction with a variety visual media platforms like a head mounted display or visual projectors or screens.

Use of Machine Learning for HRTF production

One of the difficulties in rendering binaural audio is finding the correct HRTFs for a specific user given a location for a sound object. In some embodiments in accordance with the present technology, the binaural audio processing system includes a machine learning system for selecting appropriate HRTFs for a specific user given location of an object. For example, the machine learning system can be used to implement one or more processes of the method 210.

Figure 14:
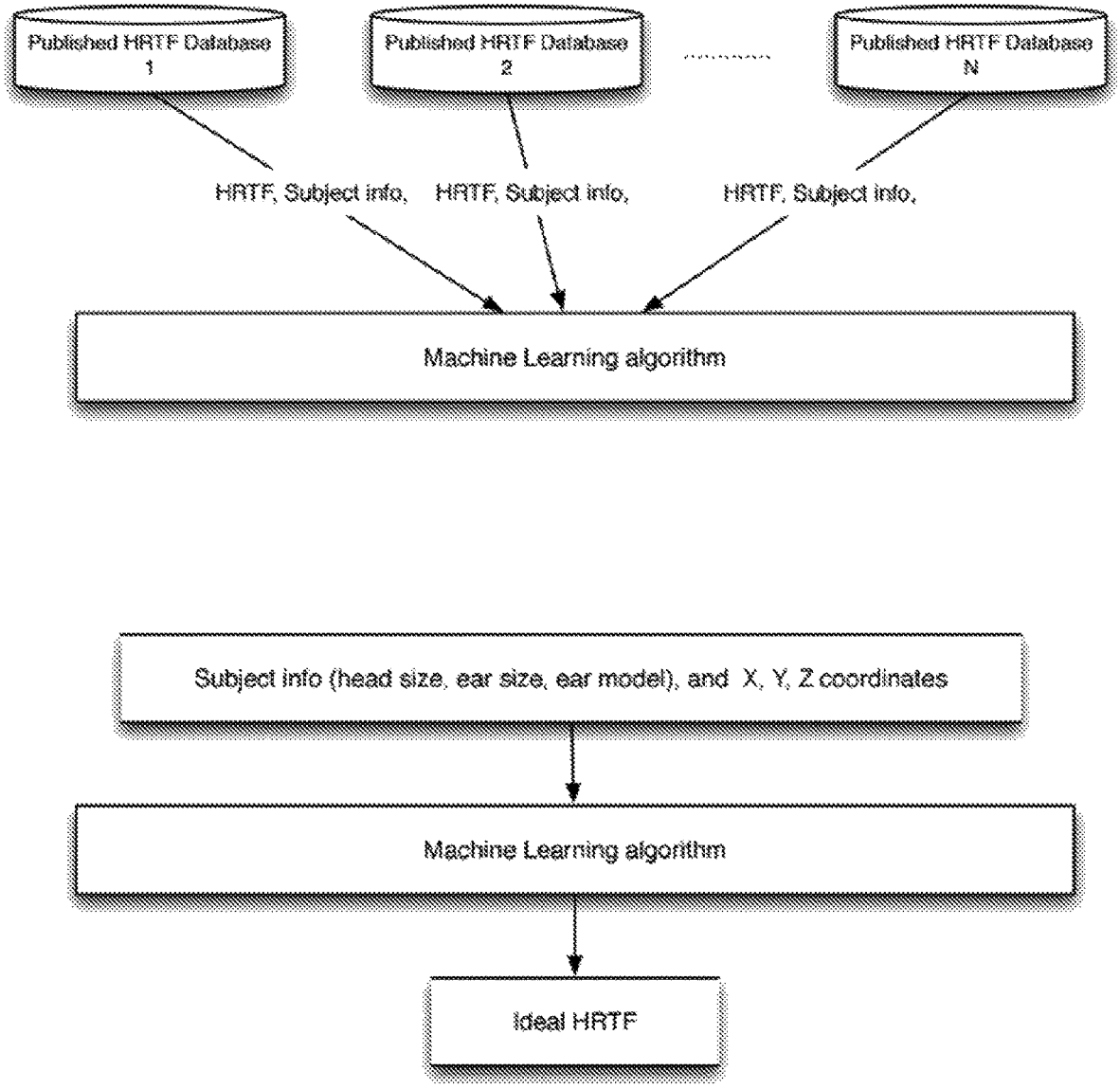
FIG. 14 shows a diagram of an example embodiment of a machine learning system for selecting appropriate HRTFs for a specific user given location of an object.

FIG. 14 shows a diagram of an example embodiment of a machine learning system for selecting appropriate HRTFs for a specific user given location of an object. The diagram illustrates an example mapping of how some or all of the existing, available databases along with the location of measured HRTFs and the data associated with the users (e.g., head size, and ear characteristics) can be fed into a machine learning algorithm (e.g., such a Deep Belief Network) and this system could be used to generate desired HRTFs for a specific listener given the location of a sound object.

The disclosed technology includes systems, devices and methods for binaural audio processing for creating spatial impressions of audio signals. The example algorithms described herein includes preparation of the HRTFs by decoupling each ear and accounting the associated delay and attenuation for each ear, and determination of the new delay values, attenuation values, and HRTFs for each ear based on the desired virtual source location. Example implementations of the example algorithms can provide the highest quality, most realistic binaural synthesis, and the best externalization effect of any binaural synthesis techniques. Example utilities of the disclosed technology may include any application which uses immersive sound (e.g., virtual reality, augmented reality, games, movies, and music).

In some implementations of the systems, devices and methods for binaural audio processing, interpolation of the HRTFs includes preparation of an HRTF for a location based on recorded HRTFs at multiple distances.

Figure 15:
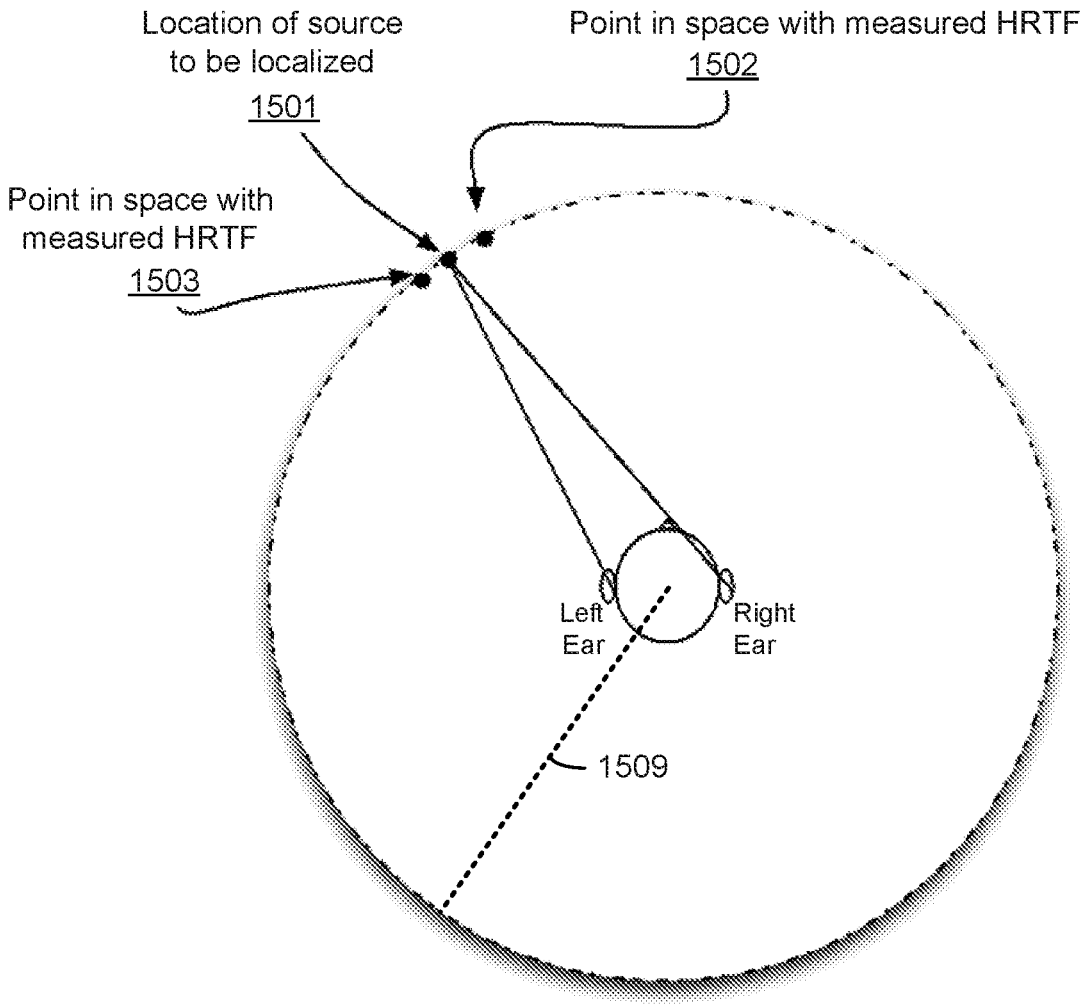
FIG. 15 shows a diagram depicting an example use of interpolation for generating an HRTF in an example binaural audio processing method based on an HRTF at multiple distances.

FIG. 15 shows a diagram depicting an example of interpolation process for generating an HRTF for point 1501 based on measured points 1502 and 1503 that are measured at the same radius as point 1501. The diagram of FIG. 15 shows an example situation where a set of HRTFs have been recorded at a certain radius 1509, where it is of interest in obtaining an HRTF for point 1501 that is at the same distance as the recorded HRTF and in between the two points 1502 and 1503 which are points with measured HRTFs. After the ITD (delay) has been deleted from point 1502 and 1503 and their amplitude has been adjusted based on their distance to the subject, one can use two approaches for obtaining the interpolation. For example, (1) a linear interpolation can be used based on the distance between 1501 to 1502 and 1503; or, for example, (2) the HRTFs for point 1502 and 1503 are put thorough a minimum-phase processing and then a linear interpolation is used to obtain the HRTF for point 1501.

Figure 16:
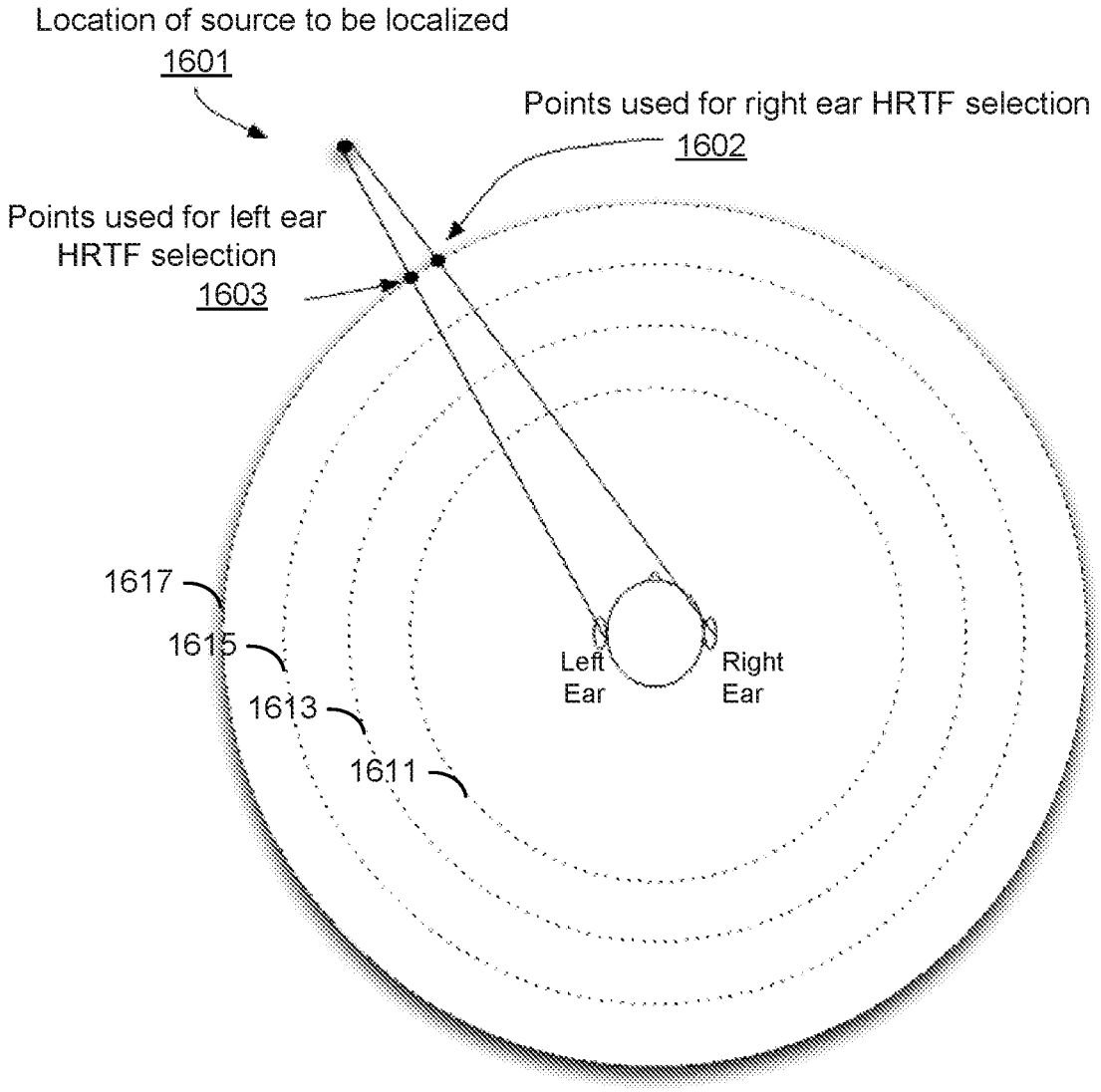
FIG. 16 shows a diagram depicting an example implementation of an example spatial binaural audio processing method where HRTFs are generated for a point which is farther than the largest distance measured HRTF sets.

FIG. 16 shows a diagram depicting an example implementation of an example spatial binaural audio processing method where HRTFs are generated for a point which is farther than the largest-distance measured HRTF sets. The diagram of FIG. 16 shows an example situation where multiple sets of HRTFs have been recorded with different distances 1611, 1613, 1615 and 1617, where it is of interest to obtain an HRTF for a point 1601 that is at a distance to the subject which is greater than the largest radius of HRTF sets recorded, i.e., distance 1617. In this case, the method can include drawing a line from the point 1601 to the two ears and using the HRTFs for each ear based on the points 1602 and 1603 for the right ear and left ear, respectively, on which the two lines cross the circle which represent the largest recorded HRTF. The HRTF for these chosen points themselves may have to be obtained by interpolation from other points on the largest radius circle of HRTFs.

Figure 17:
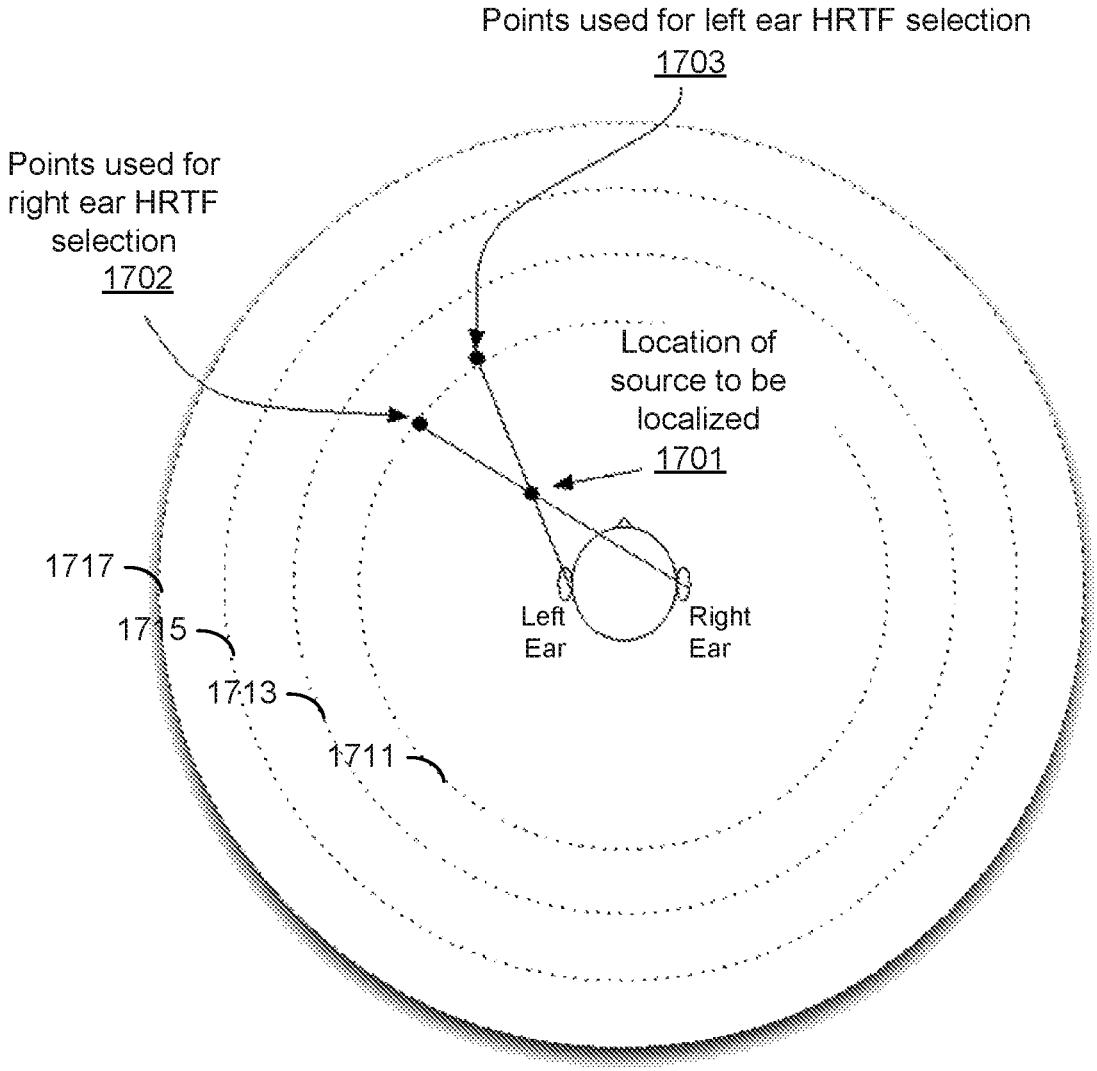
FIG. 17 shows a diagram depicting an example implementation of an example spatial binaural audio processing method where HRTFs are generated for a point which is closer the subject than the shortest distance measured HRTF sets.

FIG. 17 shows a diagram depicting an example implementation of an example spatial binaural audio processing method where HRTFs are generated for a point which is closer the subject than the shortest-distance measured HRTF sets. The diagram of FIG. 17 shows an example situation where multiple sets of HRTFs have been recorded with different distances 1711, 1713, 1715 and 1717, where it is of interest to obtain an HRTF for a point 1701 that is at a distance to the subject which is less than the shortest radius of HRTF sets recorded, i.e., 1711. In this case, the method can include drawing a line from the point 1701 to the two ears, extending the lines to the circle which represents the recorded HRTFs with the shortest distance to the subject. The HRTFs for each ear can be used based on the points 1702 and 1703 for the right ear and left ear, respectively, on which the two lines cross the circle which represent the shortest distance recorded HRTF. The HRTF for these chosen points themselves may have to be obtained by interpolation from other points on the smallest radius circle of HRTFs.

Figure 18:
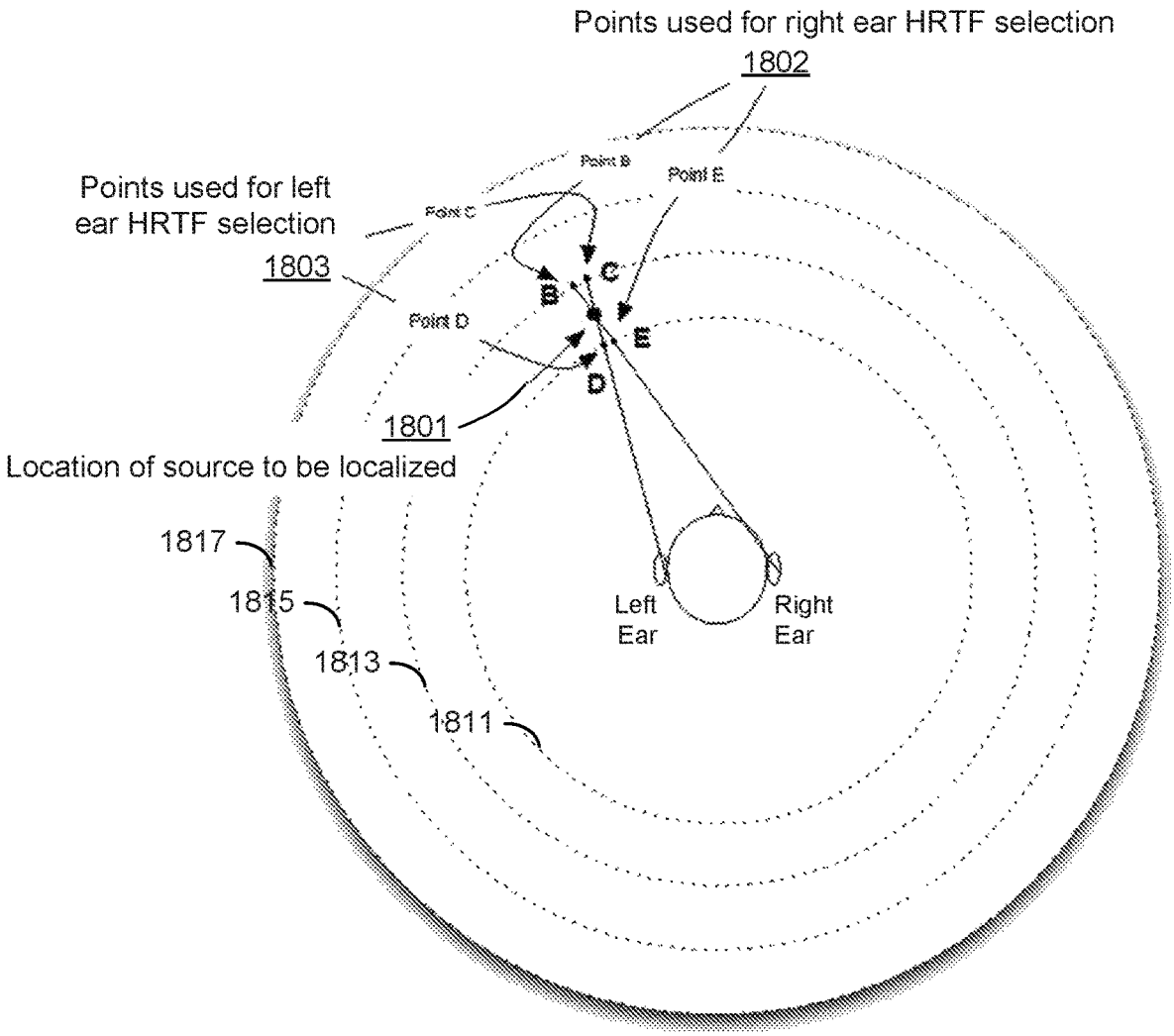
FIG. 18 shows a diagram depicting an example implementation of an example spatial binaural audio processing method where HRTFs are generated for a point which is at a distance between two radii of measured HRTFs.

FIG. 18 shows a diagram depicting an example implementation of an example spatial binaural audio processing method where HRTFs are generated for a point which is at a distance between two radii of measured HRTFs. The diagram of FIG. 18 shows an example situation where multiple sets of HRTFs have been recorded with different distances 1811, 1813, 1815 and 1817, where it is of interest to obtain an HRTF for a point 1801 which is at a distance to the subject that is in between two radii of recorded HRTF sets, i.e., in between distances 1811 and 1813. The method can include drawing a line from the left ear to the point 1802B and 1803C extending the line to the farther circle where HRTFs have been recorded. Wherever this line crosses, the circles closer and father from the distance compared to point 1801 are chosen as interpolating points for the production of the left ear's HRTF and the right ear's HRTF. In the diagram, points 1803C and 1803D can be used for the generation of the HRTFs for the left ear for point 1801. In some instances, for example, points 1803C and 1803D may not fall on locations for which we have measured data, and the interpolation mechanism for multiple points, as described with respect to FIG. 15, can be used to produce such HRTFs. Similarly, points 1802B and 1802E can be used for interpolation to generate the HRTF for the right ear of point 1801.

HRTF measurements often can be done in various elevations as well. Similar techniques as those described with respect to FIG. 18 can be used to interpolate between two elevations to obtain the HRTFs for the left and right ear for a point that is located in between two radius of measurement and two elevations of measurements.

Figure 19:
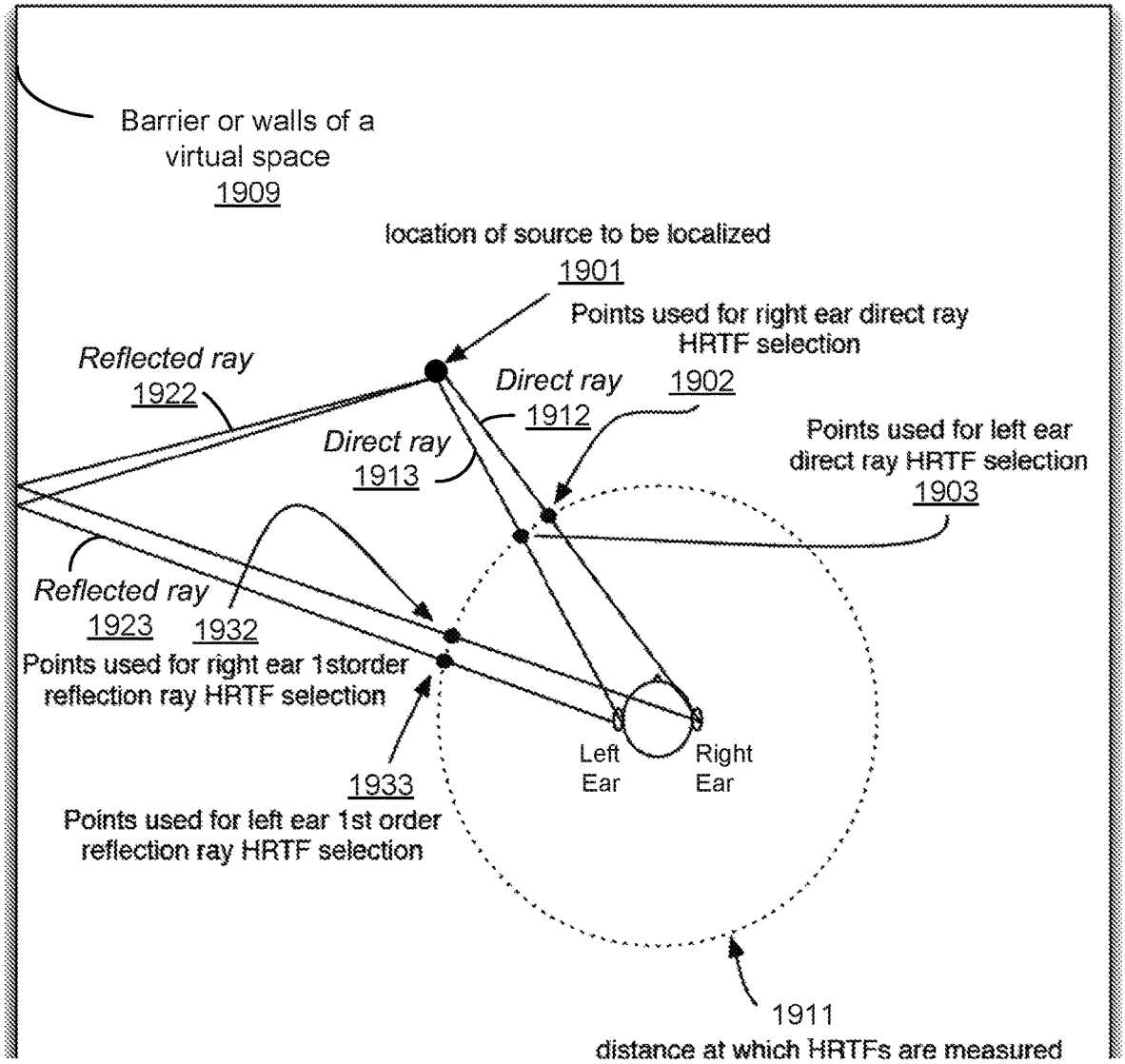
FIG. 19 show a diagram depicting an example implementation for HRTF selection for each ear of a listener for direct and reflected sound rays for a sound source located farther than an HRTF measurement ring.

FIG. 19 show a diagram depicting an example implementation for HRTF selection for each ear of a listener for direct and reflected sound rays for a sound source located farther than an HRTF measurement ring. This example shows a sound to be simulated at a particular spatial location, e.g., played during media content being consumed by a listener, at a location 1901 having a distance with respect to the listener experiencing the media content. Implementations of the method, e.g., method 210, includes determining a first direct ray 1912 and a separate second direct ray 1913 between the listener's right ear and left ear, respectively, and the location of the sound source 1901. The first and second direct rays intersect the peripheral where the HRTFs have been measured at a distance 1911 from the listener. The method 210 at process 213 selects a right ear HRTF associated with point 1902 on the peripheral where the direct ray 1912 intersects and a left ear HRTF associated with point 1903 on the peripheral where the direct ray 1913 intersects, which are subsequently prepared in accordance with the method 210 and stored in the intermediary "cooked" database. Additionally, the method 210 determines one or more reflected rays for each of the left and right ears, which may reflect from barriers, walls, or other simulated (virtual) structures that exist in the media content being consumed. In the example of FIG. 19, the listener is in a virtual space with at least a wall from which sound emanating from the sound source 1901 can reflect off of toward the listener. The diagram depicts just one set of reflected rays 1922 and 1923 corresponding to the right ear and the left ear, respectively, of the listener. Yet, it is understood that a near infinite number of reflected rays can be created for simulating the spatial aspect of the sound from the source 1901 in accordance with the disclosed methods. Here, in this example, the method 210 at process 213 selects an additional right ear HRTF associated with point 1932 on the peripheral where the reflected ray 1922 intersects, and selects an additional left ear HRTF associated with point 1933 on the peripheral where the reflected ray 1923 intersects, of which these additional HRTFs are also prepared in accordance with the method 210 and stored in the intermediary "cooked" database. The intermediary HRTFs (associated with the selected direct ray HRTFs and selected reflected ray HRTFs) can be subsequently selected for further processing in accordance with the method 220 to produce the binaural audio signals that are rendered as actual sound at the left and right speakers of devices in accordance with the present technology that synthesizes the spatial effect of the synthetic sound at the appropriate time with respect to the played media.

HRTF measurements are organized in many different ways and in various spatial organizations. For example, the disclosed systems, devices and methods for binaural audio processing for creating spatial impressions of audio signals can be used to separate the process of generation of HRTFs for the left and right ear and navigate the HRTF database accordingly. In such implementations, for example, the generated HRTFs for the left and right ear continually change compared to each other and provide a better reproduction of physical measured HRTFs.

EXAMPLES

In some example embodiments in accordance with the present technology (example A1), a method for binaural audio signal processing includes generating a first head-related transfer function (HRTF) for a left ear of a listener based on a sound to be synthesized from a source located at a first distance from the listener's left ear; generating, separately with respect to the first HRTF, a second HRTF for a right ear of the listener based on the sound to be synthesized from the source located at a second distance from the listener's right ear; and synthesizing a binaural sound for a first speaker corresponding to the left ear of the listener and a second speaker corresponding to the right ear of the listener, in which the synthesized binaural sound contains spatial auditory information to simulate the sound emanating from the source differently in each ear of the listener based on the separate first and second HRTFs for the left ear and the right ear, respectively.

Example A2 includes the method of example A1, in which the generating the first HRTF for the left ear and generating the second HRTF for the right ear includes: calculating distances between the source of the sound to be synthesized and each of the left ear and right ear of the listener; calculating at least one of one or more delay parameters, one or more attenuation parameters, or one or more angles associated with each ear using the calculated distances; interpolating the first HRTF for the left ear of the listener based on parameters associated with the left ear; interpolating the second HRTF for the right ear of the listener based on parameters associated with the right ear; and applying a convolution to the interpolated HRTFs for each ear.

Example A3 includes the method of example A2, further including selecting a modified HRTF set from an intermediary HRTF database, in which the modified HRTF set includes HRTF data decoupled for left and right ear impulses, attenuation and volume, in which the modified HRTF set is used in the interpolating the first HRTF for the left ear and the second HRTF for the right ear.

Example A4 includes the method of example A2, further including prior to the synthesizing, applying de-correlation and equalization filters to output data of the applied convolution.

Example A5 includes the method of example A1, in which the spatial auditory information includes direct ray and reflection data associated with the source of the sound to be synthesized.

Example A6 includes the method of example A1, further including producing intermediary HRTFs that are modified from premade HRTFs stored in a premade HRTF database, the intermediary HRTFs including HRTF data decoupled for left and right ear impulses, attenuation and volume.

Example A7 includes the method of example A6, in which the producing the intermediary HRTFs includes: determining parameters associated with the sound to be synthesized, in which the parameters include spatial parameters of the sound with respect to the listener; selecting one or more of the premade HRTFs from the premade HRTF database based on the determined spatial parameters; decoupling left ear and right ear impulses of the selected one or more premade HRTFs; removing delay information from the selected one or more premade HRTFs; and adjusting volume information of the selected one or more premade HRTFs, in which the decoupling, removing, and adjusting produces a set of the intermediary HRTFs corresponding to the left ear and the right ear.

Example A8 includes the method of example A7, in which the spatial parameters include a distance between the listener and a source of the sound to be synthesized.

Example A9 includes the method of example A7, further including interpolating the set of the intermediary HRTFs; and storing the interpolated set of the intermediary HRTF in an intermediary HRTF database.

Example A10 includes the method of example A7, further including processing the set of the intermediary HRTFs for minimum-phase processing; interpolating the minimum-phase processed HRTF set; and storing the interpolated, minimum-phase processed HRTF set in an intermediary HRTF database.

In some example embodiments in accordance with the present technology (example A11), a binaural audio device includes a first speaker to project a first synthesized audio output to one of two ears of a listener; a second speaker to project a second synthesized audio output to the other of the two ears of the listener; a data processing unit in communication with the first speaker and second speaker to produce distinct binaural audio outputs for the first speaker and the second speaker; and a binaural audio processing module to generate a first head-related transfer function (HRTF) for a first ear of the two ears of the listener and a second HRTF for a second ear of the two ears of the listener, in which the binaural audio processing module is configured to separately generate the first HRTF and the second HRTF based on a sound to be synthesized from a source located at a distance from the listener, and to synthesize a binaural sound including the first and the second synthesized audio outputs for the first and the second speakers, respectively, in which the synthesized binaural sound contains spatial auditory information to simulate the sound emanating from the source differently in each ear of the listener.

Example A12 includes the device of example A11, in which the binaural audio processing module is configured to generate the first HRTF for the first ear and generate the second HRTF for the second ear by: calculating distances between the source of the sound to be synthesized and each of the first ear and second ear of the listener; calculating at least one of one or more delay parameters, one or more attenuation parameters, or one or more angles associated with each of the first ear and the second ear using the calculated distances; interpolating the first HRTF for the first ear of the listener based on parameters associated with the first ear; interpolating the second HRTF for the second ear of the listener based on parameters associated with the second ear; and applying a convolution to the interpolated HRTFs for each ear.

Example A13 includes the device of example A12, in which the binaural audio processing module is configured to select a modified HRTF set from an intermediary HRTF database, in which the modified HRTF set includes HRTF data decoupled for left and right ear impulses, attenuation and volume, in which the binaural audio processing module is configured to use the modified HRTF set to interpolate the first HRTF for the first ear and interpolate the second HRTF for the second ear.

Example A14 includes the device of example A13, in which the device is in communication with one or more computing devices in the cloud in communication with one or more databases including the intermediary HRTF database.

Example A15 includes the device of example A12, in which the binaural audio processing module is configured to apply de-correlation and equalization filters to output data of the applied convolution.

Example A16 includes the device of example A11, in which the spatial auditory information includes direct ray and reflection data associated with the source of the sound to be synthesized.

Example A17 includes the device of example A11, in which the data processing unit is configured to control projection of the first and second synthesized audio outputs to the first and second speakers, respectively, based on the synthesized binaural sound by the binaural audio processing module.

Example A18 includes the device of example A11, in which the first speaker is a left ear headphone speaker and the second speaker is a right ear headphone speaker.

Example A19 includes the device of example A11, in which the first and second speakers are included in a binaural speaker.

Example A20 includes the device of example A19, in which the binaural speaker is included in an array of binaural speakers arranged in a venue, where at least one of the binaural speakers of the array is associated with a select area of the venue to project the synthesized binaural sound at an individual user.

In some example embodiments in accordance with the present technology (example A21), a method for binaural audio signal processing includes interpolating a head-related transfer function (HRTF) for each of a left ear and a right ear of a listener; calculating distances between a source of a sound to be synthesized and each of the left ear and right ear of the listener; calculating at least one of one or more delay parameters, one or more attenuation parameters, or one or more angles associated with each ear using the calculated distances; interpolating values per block of a space covering at least the listener and the source of the sound; applying a convolution including the interpolated values per block and the interpolated HRTF for each ear; and synthesizing a binaural sound for a first speaker corresponding to the left ear of the listener and a second speaker corresponding to the right ear of the listener, in which the synthesized binaural sound contains spatial auditory information to simulate the sound emanating from the source differently in each ear of the listener.

Example A22 includes the method of example A21, further including selecting a modified HRTF set from an intermediary HRTF database, in which the modified HRTF set includes HRTF data decoupled for left and right ear impulses, attenuation and volume, in which the modified HRTF set is used in the interpolating the HRTF for each ear.

Example A23 includes the method of example A21, further including, prior to the synthesizing, applying de-correlation and equalization filters to output data of the applied convolution.

Example A24 includes the method of example A21, in which the spatial auditory information includes direct ray and reflection data associated with the first speaker and the second speaker.

In some example embodiments in accordance with the present technology (example A25), a method for producing intermediary head-related transfer functions (HRTFs) includes determining parameters associated with a sound to be synthesized, in which the parameters include spatial parameters of the sound with respect to a listener; selecting one or more premade HRTFs from a published database having a plurality of the premade HRTFs based on the determined spatial parameters; decoupling left ear and right ear impulses of the selected one or more premade HRTFs; removing delay information from the selected one or more premade HRTFs; and adjusting volume information of the selected one or more premade HRTFs, in which the decoupling, removing, and adjusting produces a modified HRTF set.

Example A26 includes the method of example A25, in which the spatial parameters include a distance between the listener and a source of the sound to be synthesized.

Example A27 includes the method of example A25, further including interpolating the modified HRTF set; and storing the interpolated HRTF set in an intermediary HRTF database.

Example A28 includes the method of example A25, further including processing the modified HRTF set for minimum-phase processing; interpolating the minimum-phase processed HRTF set; and storing the interpolated, minimum-phase processed HRTF set in an intermediary HRTF database.

In some example embodiments in accordance with the present technology (example A29), a computer program product includes a nonvolatile computer-readable storage medium having instructions stored thereon for binaural audio signal processing, the instructions including code for generating a first head-related transfer function (HRTF) for a left ear of a listener based on a sound to be synthesized from a source located at a first distance from the listener's left ear; code for generating, separately with respect to the first HRTF, a second HRTF for a right ear of the listener based on the sound to be synthesized from the source located at a second distance from the listener's right ear; and code for synthesizing a binaural sound for a first speaker corresponding to the left ear of the listener and a second speaker corresponding to the right ear of the listener, in which the synthesized binaural sound contains spatial auditory information to simulate the sound emanating from the source differently in each ear of the listener based on the separate first and second HRTFs for the left ear and the right ear, respectively.

Example A30 includes the computer program product of example A29, in which the code for generating the first HRTF for the left ear and generating the second HRTF for the right ear includes: code for calculating distances between the source of the sound to be synthesized and each of the left ear and right ear of the listener; code for calculating at least one of one or more delay parameters, one or more attenuation parameters, or one or more angles associated with each ear using the calculated distances; code for interpolating the first HRTF for the left ear of the listener based on parameters associated with the left ear; code for interpolating the second HRTF for the right ear of the listener based on parameters associated with the right ear; and code for applying a convolution to the interpolated HRTFs for each ear.

Example A31 includes the computer program product of example A30, the instructions further including code for selecting a modified HRTF set from an intermediary HRTF database, in which the modified HRTF set includes HRTF data decoupled for left and right ear impulses, attenuation and volume, in which the modified HRTF set is used in the interpolating the first HRTF for the left ear and the second HRTF for the right ear.

Example A32 includes the computer program product of example A30, the instructions further including code for applying de-correlation and equalization filters to output data of the applied convolution.

Example A33 includes the computer program product of example A29, in which the spatial auditory information includes direct ray and reflection data associated with the source of the sound to be synthesized.

Example A34 includes the computer program product of example A29, the instructions further including code for producing intermediary HRTFs that are modified from premade HRTFs stored in a premade HRTF database, the intermediary HRTFs including HRTF data decoupled for left and right ear impulses, attenuation and volume.

Example A35 includes the computer program product of example A34, in which the code for producing the intermediary HRTFs includes: code for determining parameters associated with the sound to be synthesized, in which the parameters include spatial parameters of the sound with respect to the listener; code for selecting one or more of the premade HRTFs from the premade HRTF database based on the determined spatial parameters; code for decoupling left ear and right ear impulses of the selected one or more premade HRTFs; code for removing delay information from the selected one or more premade HRTFs; and code for adjusting volume information of the selected one or more premade HRTFs, in which the decoupling, removing, and adjusting produces a set of the intermediary HRTFs corresponding to the left ear and the right ear.

Example A36 includes the computer program product of example A35, in which the spatial parameters include a distance between the listener and a source of the sound to be synthesized.

Example A37 includes the computer program product of example A35, the instructions further including code for interpolating the set of the intermediary HRTFs; and code for storing the interpolated set of the intermediary HRTF in an intermediary HRTF database.

Example A38 includes the computer program product of example A35, the instructions further including code for processing the set of the intermediary HRTFs for minimum-phase processing; interpolating the minimum-phase processed HRTF set; and code for storing the interpolated, minimum-phase processed HRTF set in an intermediary HRTF database.

In some example embodiments in accordance with the present technology (example B1), a method for binaural audio signal processing includes generating a head-related transfer function (HRTF) for each of a left ear and a right ear of a listener based on a sound to be synthesized from a source located at a distance from the listener; and synthesizing a binaural sound for a first speaker corresponding to the left ear of the listener and a second speaker corresponding to the right ear of the listener, wherein the synthesized binaural sound contains spatial auditory information to simulate the sound emanating from the source differently in each ear of the listener.

In some example embodiments in accordance with the present technology (example B2), a method for binaural audio signal processing includes interpolating a head-related transfer function (HRTF) for each of a left ear and a right ear of a listener; calculating distances between a source of a sound to be synthesized and each of the left ear and right ear of the listener; calculating at least one of one or more delay parameters, one or more attenuation parameters, or one or more angles associated with each ear using the calculated distances; interpolating values per block of a space covering at least the listener and the source of the sound; applying a convolution function including the interpolated values per block and the interpolated HRTF for each ear; and synthesizing a binaural sound for a first speaker corresponding to the left ear of the listener and a second speaker corresponding to the right ear of the listener, wherein the synthesized binaural sound contains spatial auditory information to simulate the sound emanating from the source differently in each ear of the listener.

Example B3 includes the method of example B2, further including selecting a modified HRTF set from an intermediary HRTF database, wherein the modified HRTF set includes HRTF data decoupled for left and right ear impulses, attenuation and volume, wherein the modified HRTF set is used in the interpolating the HRTF for each ear.

Example B4 includes the method of example B2, further including prior to the synthesizing, applying de-correlation and equalization filters to output data of the applied convolution function.

Example B5 includes the method of example B2, in which the spatial auditory information includes direct ray and reflection data associated with the first speaker and the second speaker.

In some example embodiments in accordance with the present technology (example B6), a method for producing intermediary head-related transfer functions (HRTFs) includes determining parameters associated with a sound to be synthesized, in which the parameters include spatial parameters of the sound with respect to a listener; selecting one or more premade HRTFs from a published database having a plurality of the premade HRTFs based on the determined spatial parameters; decoupling left ear and right ear impulses of the selected one or more premade HRTFs; removing delay information from the selected one or more premade HRTFs; and adjusting volume information of the selected one or more premade HRTFs, in which the decoupling, removing, and adjusting produces a modified HRTF set.

Example B7 includes the method of example B6, wherein the spatial parameters include a distance between the listener and a source of the sound to be synthesized.

Example B8 includes the method of example B6, further includes interpolating the modified HRTF set; and storing the interpolated HRTF set in an intermediary HRTF database.

Example B9 includes the method of example B6, further including processing the modified HRTF set for minimum-phase processing; interpolating the minimum-phase processed HRTF set; and storing the interpolated, minimum-phase processed HRTF set in an intermediary HRTF database.

In some example embodiments in accordance with the present technology (example B10), a binaural audio device a first speaker to project a first synthesized audio output to one of two ears of a listener; a second speaker to project a second synthesized audio output to the other of the two ears of the listener; a data processing unit in communication with the first speaker and second speaker to produce distinct binaural audio outputs for the first speaker and the second speaker; and a binaural audio processing module to generate a head-related transfer function (HRTF) for each of the two ears of the listener based on a sound to be synthesized from a source located at a distance from the listener, and to synthesize a binaural sound including the first and the second synthesized audio outputs for the first and the second speakers, respectively, wherein the synthesized binaural sound contains spatial auditory information to simulate the sound emanating from the source differently in each ear of the listener.

Example B11 includes the device of example B10, wherein the data processing unit is configured to control projection of the first and second synthesized audio outputs to the first and second speakers, respectively, based on the synthesized binaural sound by the binaural audio processing module.

Example B12 includes the device of example B10, wherein the device includes portable speakers.

Example B13 includes the device of example B10, wherein the device implements the method of any of example B1-B9.

Example B14 includes the device of example B10, wherein the device is included in a virtual or augmented reality system including binaural spatial audio processed according to the method of any of examples B1-B9.

Implementations of the subject matter and the functional operations described in this patent document can be implemented in various systems, digital electronic circuitry, or in computer software, firmware, or hardware, including the structures disclosed in this specification and their structural equivalents, or in combinations of one or more of them. Implementations of the subject matter described in this specification can be implemented as one or more computer program products, i.e., one or more modules of computer program instructions encoded on a tangible and non-transitory computer readable medium for execution by, or to control the operation of, data processing apparatus. The computer readable medium can be a machine-readable storage device, a machine-readable storage substrate, a memory device, a composition of matter effecting a machine-readable propagated signal, or a combination of one or more of them. The term "data processing unit" or "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them.

A computer program (also known as a program, software, software application, script, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Computer readable media suitable for storing computer program instructions and data include all forms of nonvolatile memory, media and memory devices, including by way of example semiconductor memory devices, e.g., EPROM, EEPROM, and flash memory devices. The processor and the memory can be supplemented by, or incorporated in, special purpose logic circuitry.

It is intended that the specification, together with the drawings, be considered exemplary only, where exemplary means an example. As used herein, the singular forms "a", "an" and "the" are intended to include the plural forms as well, unless the context clearly indicates otherwise. Additionally, the use of "or" is intended to include "and/or", unless the context clearly indicates otherwise.

While this patent document contains many specifics, these should not be construed as limitations on the scope of any invention or of what may be claimed, but rather as descriptions of features that may be specific to particular embodiments of particular inventions. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described in this patent document should not be understood as requiring such separation in all embodiments.

Only a few implementations and examples are described and other implementations, enhancements and variations can be made based on what is described and illustrated in this patent document.

What is claimed is:

1. A method for binaural audio signal processing, comprising:

obtaining a first head-related transfer function (HRTF) for a left ear of a listener based on a sound source located at a first distance from the listener's left ear, wherein the first HRTF is such that delay information is removed from the first HRTF and a volume of the first HRTF is adjusted for attenuation associated with the removed delay information;

obtaining a second HRTF for a right ear of the listener based on the sound source located at a second distance from the listener's right ear, wherein the second HRTF is such that delay information is removed from the second HRTF and a volume of the second HRTF is adjusted for attenuation associated with the removed delay information;

calculating at least one of: one or more delay parameters or one or more attenuation parameters associated with the left ear and the right ear;

modifying the first HRTF based on the calculated parameters associated with the left ear;

modifying the second HRTF based on the calculated parameters associated with the right ear; and synthesizing a binaural sound for a first speaker corresponding to the left ear of the listener and a second speaker corresponding to the right ear of the listener, wherein the synthesized binaural sound contains spatial auditory information, based on the modified first HRTF and the modified second HRTF for the left ear and the right ear, respectively.

2. The method of claim 1, comprising:

applying a convolution to the modified first HRTF and the modified second HRTF.

3. The method of claim 2, further comprising:

applying de-correlation and/or equalization filters to output data of the applied convolution.

4. The method of claim 1, further comprising:

selecting a modified HRTF set from an intermediary HRTF database, wherein the modified HRTF set includes HRTF data decoupled for left and right ear impulses, attenuation and volume, wherein the modified HRTF set is used in the obtaining the first HRTF for the left ear and the second HRTF for the right ear.

5. The method of claim 1, wherein the spatial auditory information includes direct ray and reflection data associated with the sound source.

6. The method of claim 1, further comprising:

producing intermediary HRTFs that are modified from premade HRTFs stored in a premade HRTF database, the intermediary HRTFs including HRTF data decoupled for left and right ear impulses, attenuation and volume.

7. The method of claim 6, wherein the producing the intermediary HRTFs includes:

determining parameters associated with a sound to be synthesized, wherein the parameters include spatial parameters of the sound with respect to the listener;

selecting one or more of the premade HRTFs from the premade HRTF database based on the determined spatial parameters;

decoupling left ear and right ear impulses of the selected one or more premade HRTFs;

removing delay information from the selected one or more premade HRTFs; and adjusting volume information of the selected one or more premade HRTFs, wherein the decoupling, removing, and adjusting produces a set of the intermediary HRTFs corresponding to the left ear and the right ear.

8. The method of claim 7, wherein the spatial parameters include a distance between the listener and a source of the sound to be synthesized.

9. The method of claim 7, further comprising:

interpolating the set of the intermediary HRTFs; and storing the interpolated set of the intermediary HRTF in an intermediary HRTF database.

10. The method of claim 7, further comprising:

putting the set of the intermediary HRTFs through a minimum-phase processing;

interpolating the minimum-phase processed HRTF set; and storing the interpolated, minimum-phase processed HRTF set in an intermediary HRTF database.

11. A binaural audio device, comprising:

a first speaker configured to project a first synthesized audio output to a first ear of a listener;

a second speaker configured to project a second synthesized audio output to a second ear of the listener;

a data processing unit in communication with the first speaker and the second speaker configured to produce distinct audio outputs for the first speaker and the second speaker; and a binaural audio processing module configured to obtain a first head-related transfer function (HRTF) for the first ear of the listener and a second HRTF for the second ear of the listener based on a sound source located at a first distance from the listener's first ear and a second distance from the listener's second ear, wherein the first HRTF is such that delay information is removed from the first HRTF and a volume of the first HRTF is adjusted for attenuation associated with the removed delay information, and wherein the second HRTF is such that delay information is removed from the second HRTF and a volume of the second HRTF is adjusted for attenuation associated with the removed delay information, wherein the binaural audio processing module is further configured to calculate at least one of: one or more delay parameters or one or more attenuation parameters associated with the first ear and the second ear, modify the first HRTF based on the calculated parameters associated with the first ear, modify the second HRTF based on the calculated parameters associated with the second ear, and wherein the binaural audio processing module is further configured to synthesize a binaural sound for the first speaker and the second speaker based on the modified first HRTF and the modified second HRTF, respectively, wherein the synthesized binaural sound contains spatial auditory information.

12. The device of claim 11, wherein the binaural audio processing module is configured to:

apply a convolution to the modified first HRTF and the modified second HRTF.

13. The device of claim 12, wherein the binaural audio processing module is configured to apply de-correlation and/or equalization filters to output data of the applied convolution.

14. The device of claim 11, wherein the binaural audio processing module is configured to select a modified HRTF set from an intermediary HRTF database, wherein the modified HRTF set includes HRTF data decoupled for left and right ear impulses, attenuation and volume, wherein the binaural audio processing module is configured to use the modified HRTF set to obtain the first HRTF for the first ear and obtain the second HRTF for the second ear.

15. The device of claim 14, wherein the device is in communication with one or more computing devices in the cloud in communication with one or more databases including the intermediary HRTF database.

16. The device of claim 11, wherein the spatial auditory information includes direct ray and reflection data associated with the sound source.

17. The device of claim 11, wherein the data processing unit is configured to control projection of the first and second synthesized audio outputs by the first and second speakers, respectively, based on the binaural sound synthesized by the binaural audio processing module.

18. The device of claim 11, wherein the first speaker is a left ear headphone speaker and the second speaker is a right ear headphone speaker.

19. The device of claim 11, wherein the first and second speakers are included in a binaural speaker.

20. The device of claim 19, wherein the binaural speaker is included in an array of binaural speakers arranged in a venue, where at least one of the binaural speakers of the array is associated with a select area of the venue to project the synthesized binaural sound at an individual user.

21. A method for binaural audio signal processing, comprising:

interpolating a first head-related transfer function (HRTF) for a left ear of a listener and interpolating a second head-related transfer function for a right ear of the listener, wherein the first HRTF is such that delay information is removed from the first HRTF and a volume of the first HRTF is adjusted for attenuation associated with the removed delay information, and wherein the second HRTF is such that delay information is removed from the second HRTF and a volume of the second HRTF is adjusted for attenuation associated with the removed delay information;

calculating distances between a source of a sound to be synthesized and each of the left ear and right ear of the listener;

calculating at least one of one or more delay parameters, one or more attenuation parameters, or one or more angles associated with the left ear and the right ear using the calculated distances;

modifying the first interpolated HRTF based on the calculated parameters associated with the left ear;

modifying the second interpolated HRTF based on the calculated parameters associated with the right ear;

interpolating values per block of a space covering at least the listener and the source of the sound;

applying a convolution including the interpolated values per block and the modified interpolated HRTF for each ear; and synthesizing a binaural sound for a first speaker corresponding to the left ear of the listener and a second speaker corresponding to the right ear of the listener, wherein the synthesized binaural sound contains spatial auditory information.

22. The method of claim 21, further comprising:

selecting a modified HRTF set from an intermediary HRTF database, wherein the modified HRTF set includes HRTF data decoupled for left and right ear impulses, attenuation and volume, wherein the modified HRTF set is used in the interpolating the first HRTF and the second HRTF.

23. The method of claim 21, further comprising:

prior to the synthesizing, applying de-correlation and/or equalization filters to output data of the applied convolution.

24. The method of claim 21, wherein the spatial auditory information includes direct ray and reflection data associated with the first speaker and the second speaker.

25. A method for producing intermediary head-related transfer functions (HRTFs), comprising:

determining parameters associated with a sound to be synthesized, wherein the parameters include spatial parameters of the sound with respect to a listener;

selecting one or more premade HRTFs from a database having a plurality of the premade HRTFs based on the determined spatial parameters;

decoupling left ear and right ear impulses of the selected one or more premade HRTFs;

removing delay information from the selected one or more premade HRTFs; and adjusting volume information of the selected one or more premade HRTFs for attenuation associated with the removed delay information, wherein the decoupling, removing, and adjusting produces a modified HRTF set.

26. The method of claim 25, wherein the spatial parameters include a distance between the listener and a source of the sound to be synthesized.

27. The method of claim 25, further comprising:

interpolating the modified HRTF set; and storing the interpolated HRTF set in an intermediary HRTF database.

28. The method of claim 25, further comprising:

putting the modified HRTF set through a minimum-phase processing;

interpolating the minimum-phase processed HRTF set; and storing the interpolated, minimum-phase processed HRTF set in an intermediary HRTF database.

* * * * *